US008944889B2

(12) United States Patent
Frommer et al.

(10) Patent No.: US 8,944,889 B2
(45) Date of Patent: Feb. 3, 2015

(54) RECIPROCATING SKATE BLADE SHARPENER

(75) Inventors: Thomas P. Frommer, Mount Albert (CA); Christopher Theodore Kontos, Penetanguishene (CA); Shawn Marchand, Penetanguishene (CA); Marc Plourde, Midland (CA); Austin O'Neill, Midland (CA); Kurt Schatz, Newmarket (CA)

(73) Assignee: Magna Closures Inc., Newmarket (CA)

( * ) Notice: Subject to any disclaimer, the term of this patent is extended or adjusted under 35 U.S.C. 154(b) by 887 days.

(21) Appl. No.: 13/139,895

(22) PCT Filed: Dec. 21, 2009

(86) PCT No.: PCT/CA2009/001890

§ 371 (c)(1),
(2), (4) Date: Jun. 15, 2011

(87) PCT Pub. No.: WO2010/069082

PCT Pub. Date: Jun. 24, 2010

(65) Prior Publication Data

US 2011/0247460 A1 Oct. 13, 2011

Related U.S. Application Data

(60) Provisional application No. 61/139,171, filed on Dec. 19, 2008, provisional application No. 61/166,367, filed on Apr. 3, 2009, provisional application No. 61/243,698, filed on Sep. 18, 2009.

(51) Int. Cl.
*B24B 9/04* (2006.01)
*B24D 15/06* (2006.01)

(Continued)

(52) U.S. Cl.
CPC . *B24B 3/003* (2013.01); *A63C 3/10* (2013.01); *A63C 11/06* (2013.01)
USPC ..... 451/45; 451/349

(58) Field of Classification Search
CPC ..... B24B 3/003; B24B 9/04; A63C 3/00; A63C 2203/00; B24D 15/066
USPC ..... 451/45, 558, 555, 349; 76/82, 86, 88
See application file for complete search history.

(56) References Cited

U.S. PATENT DOCUMENTS 3,585,880 A 6/1971 Kabriel
3,597,880 A 8/1971 Norgiel (Continued)

FOREIGN PATENT DOCUMENTS

CA 984611 A1 3/1976
CA 1003644 A1 1/1977

(Continued)

OTHER PUBLICATIONS

EP 09832796, Supplementary European Search Report, Jun. 12, 2013.

*Primary Examiner* — Robert Rose

(57) ABSTRACT

In one aspect, the invention is directed to a sharpener for sharpening a snowice travel member such as a skate blade, a ski or a snowboard, which includes a sharpening surface that is movable lengthwise along an edge face of the item to be sharpened. The sharpening surface may be movable lengthwise by means of a motor and a reciprocating mechanism, or may be manually moved by a user.

13 Claims, 30 Drawing Sheets

(51) Int. Cl.

| | |
|---|---|
| ***B24B 3/00*** | (2006.01) |
| ***A63C 3/10*** | (2006.01) |
| ***A63C 11/06*** | (2006.01) |

(56) References Cited

U.S. PATENT DOCUMENTS

| | | | | | |
|---|---|---|---|---|---|
| 3,719,006 | A | | 3/1973 | Vezeau | |
| 3,812,626 | A | | 5/1974 | Thompson | |
| 3,827,185 | A | | 8/1974 | Smith | |
| 3,839,828 | A | | 10/1974 | Arnold | |
| 3,841,030 | A | | 10/1974 | Head et al. | |
| 3,875,825 | A | * | 4/1975 | Buttafuoco | 76/83 |
| 3,921,341 | A | | 11/1975 | Thompson | |
| 4,060,013 | A | * | 11/1977 | Thompson | 76/83 |
| 4,219,975 | A | | 9/1980 | Scholler | |
| 4,235,050 | A | | 11/1980 | Consay | |
| 4,241,544 | A | | 12/1980 | Hampton | |
| 4,442,636 | A | * | 4/1984 | Obland | 451/558 |
| 4,569,158 | A | * | 2/1986 | Curmi | 451/558 |
| 4,615,144 | A | | 10/1986 | Peacock et al. | |
| 4,665,778 | A | * | 5/1987 | Lubin et al. | 76/83 |
| 4,815,240 | A | | 3/1989 | Larson | |
| 4,817,339 | A | * | 4/1989 | Weidmo et al. | 451/5 |
| 4,910,923 | A | | 3/1990 | McCabe | |
| 5,103,597 | A | | 4/1992 | Courchesne | |
| 5,189,845 | A | | 3/1993 | Courchesne | |
| 5,195,277 | A | | 3/1993 | Courchesne | |
| 5,197,232 | A | | 3/1993 | Ellestad | |
| 5,239,785 | A | | 8/1993 | Allen | |
| 5,287,657 | A | | 2/1994 | Tschida et al. | |
| 5,383,307 | A | | 1/1995 | Anderson | |
| 5,431,597 | A | | 7/1995 | Anderson | |
| 5,445,050 | A | | 8/1995 | Owens | |
| 5,492,037 | A | | 2/1996 | Graham | |
| 5,499,556 | A | | 3/1996 | Exner et al. | |
| 5,569,064 | A | | 10/1996 | Gleadall | |
| 5,591,069 | A | | 1/1997 | Wurthman | |
| 5,607,347 | A | | 3/1997 | Schoen et al. | |
| 5,879,229 | A | | 3/1999 | Anderson | |
| 6,030,283 | A | | 2/2000 | Anderson | |
| 6,312,017 | B1 | | 11/2001 | Hardwick et al. | |
| 6,726,543 | B1 | | 4/2004 | Klosterman | |
| 7,097,547 | B2 | | 8/2006 | McCroary | |

FOREIGN PATENT DOCUMENTS

| | | | |
|---|---|---|---|
| CA | 2139299 | A1 | 7/1995 |
| JP | 2048155 | A | 2/1990 |
| WO | WO 97/05988 | A1 | 2/1997 |

* cited by examiner

RECIPROCATING SKATE BLADE SHARPENER

CROSS-REFERENCE TO OTHER APPLICATIONS

This application claims the benefit of U.S. Provisional Patent Application having Ser. No. 60/337,670 and filed on Nov. 7, 2001, and claims the benefit of U.S. Provisional Patent Application Ser. No. 60/348,891 and filed on Jan. 14, 2002, and claims the benefit of U.S. Provisional Patent Application Ser. No. 60/348,891 and filed on Jan. 14, 2002, and hereby incorporates the entirety of all three provisional applications by reference.

FIELD OF THE INVENTION

The present invention relates to sharpeners and more particularly to portable sharpeners for snow/ice travel members such as ice skates, skis and snowboards.

BACKGROUND OF THE INVENTION

It is known to provide a sharpener for sharpening items such as skate blades. Some sharpeners, in particular some portable skate blade sharpeners, however suffer from one or more problems. For example, some sharpeners are not capable of easily accommodating skate blades of different thicknesses.

Another problem with some sharpeners is that they are not configured to ensure that the left and right corners of a skate blade are sharpened evenly relative to each other.

Another problem with some sharpeners is that their sharpening surfaces may be difficult and/or expensive to replace after wearing out.

It would be advantageous to provide a sharpener that at least partially overcomes one or more of these and other problems.

SUMMARY OF THE INVENTION

In one aspect, the invention is directed to a sharpener for sharpening a corner edge of a snow/ice travel member, which may be, for example, an ice travel member such as a skate blade, or a snow travel member such as a ski or a snowboard. The sharpener reciprocates a sharpening structure lengthwise along a face of the item to be sharpened. The sharpener may reciprocate along the face of the item by means of a motorized drive mechanism, or alternatively, the sharpener may be manually operated.

In a particular embodiment of the first aspect, the sharpener includes a body, a skate blade orienting structure, first and second sharpening surfaces and a drive mechanism. The skate blade orienting structure is configured to orient the skate blade along a longitudinal direction line. The first and second sharpening surfaces are positioned for sharpening first and second corner edges respectively of the skate blade. The drive mechanism is configured to move the first and second sharpening surfaces reciprocally relative to the body along a reciprocation path that is at least generally parallel to the longitudinal direction line.

In a second aspect, the invention is directed to a sharpener that has at least one sharpening surface and first and second side face guide structures that center a skate blade along a particular direction line with respect to the at least one sharpening surface. The first and second side face guide structures may be adjustable along the particular direction line so that they can accommodate a plurality of thicknesses of skate blade.

In a particular embodiment of the second aspect the sharpener includes a body, a skate blade orienting structure configured to orient the skate blade along a longitudinal direction line, at least one sharpening surface, a drive mechanism configured to move the sharpening surface relative to the body, a first skate blade side face guide surface and a second skate blade side face guide surface. The first and second skate blade side face guide surfaces are spaced apart from each other laterally by a lateral spacing and are configured to receive therebetween a skate blade having a selected thickness and for centering the skate blade on the at least one sharpening surface. At least one of the first and second skate blade side face guide surfaces may be movable laterally relative to the other, thereby adjusting the first direction line spacing to accommodate a plurality of skate blade thicknesses.

In a third aspect, the invention is directed to a sharpener that has a first sharpening surface and a second sharpening surface which sharpen first and second corner edges of a skate blade. The first and second sharpening surfaces are adjustable in terms of their spacing from each other to accommodate a plurality of thicknesses of skate blade.

In a particular embodiment of the third aspect the sharpener includes a body, a skate blade orienting structure configured to orient a skate blade along a longitudinal direction line, a drive mechanism, a first sharpening surface and a second sharpening surface. The first and second sharpening surfaces are movable by the drive mechanism for sharpening a first skate blade corner edge and a second skate blade corner edge respectively, The first and second sharpening surfaces are spaced apart from each other laterally by a lateral spacing. At least one of the first and second sharpening surfaces is movable laterally relative to the other to permit adjustment of the lateral spacing to accommodate a range of thicknesses of skate blades.

In a fourth aspect, the invention is directed to a sharpener that has a first sharpening surface and a second sharpening surface and first and second side face guide surfaces, which center a skate blade on the first and second sharpening surfaces. The first side face guide surface and the first sharpening surface cooperate to form a sharp first corner edge of the skate blade. The second side face guide surface and the second sharpening surface cooperate to form a sharp second corner edge of the skate blade.

In a particular embodiment of the fourth aspect, the sharpener includes a body, a skate blade orienting structure configured to orient a skate blade along a longitudinal direction line, a drive mechanism, a first sharpening surface and a second sharpening surface, and a first side face guide surface and a second side face guide surface. The first and second sharpening surfaces are movable by the drive mechanism for sharpening a first corner edge of a skate blade and a second corner edge of the skate blade respectively. The first and second sharpening surfaces are spaced apart laterally from each other. The first and second side face guide surfaces are positioned to centre the skate blade laterally with respect to the first and second sharpening surfaces. The first sharpening surface is angled laterally outwardly towards the sharpening base and has a first laterally outer edge that is laterally outside of the first side face guide surface and wherein the second sharpening surface is angled laterally outwardly towards the sharpening base and has a second laterally outer edge that is laterally outside of the second side face guide surface.

In a fifth aspect, the invention is directed to a sharpener that has sharpening base with a sharpening surface on it, wherein the sharpening base is disposable and is removable from the rest of the sharpener.

In a sixth aspect the invention is directed to a disposable sharpening base with the sharpening surface thereon, wherein the sharpening base is for use with a non-disposable portion of a sharpener.

In a seventh aspect, the invention is directed to a sharpener with at least one sharpening surface that applies a consistent force on an edge face of a skate blade regardless of the force that a user applies on engaging the skate blade with the sharpener.

In a particular embodiment of the seventh aspect, the sharpener includes a body including an edge face positioning surface for receiving an edge face of a skate blade, at least one sharpening surface positioned for sharpening a corner edge of the skate blade, a drive mechanism configured to move the at least one sharpening surface relative to the body, a sharpening surface engagement biasing member that, in use, is configured to bias the at least one sharpening surface to the edge face of the skate blade.

In an eighth aspect, the invention is directed to a kit of parts that includes a sharpener including at least one sharpening surface for sharpening an edge face of the skate blade, and at least one shoe, wherein together, the at least one shoe and the sharpener include a plurality of skate blade orienting structures wherein each skate blade orienting structure is configured for orienting a skate blade having a unique width along a longitudinal direction line and for centering the skate blade laterally with respect to the at least one sharpening surface.

In a ninth aspect, the invention is directed to a sharpener, including a body a snow/ice travel member orienting structure, configured to orient a snow/ice travel member along a longitudinal direction line, and a sharpening base with a sharpening surface thereon positioned for sharpening a corner edge of the snow/ice travel member. The sharpening base is disposable and is removably connectable to a non-disposable portion of the sharpener.

BRIEF DESCRIPTION OF THE DRAWINGS

The present invention will now be described by way of example only with reference to the attached drawings, in which.

DETAILED DESCRIPTION OF THE INVENTION

Figure 1A:
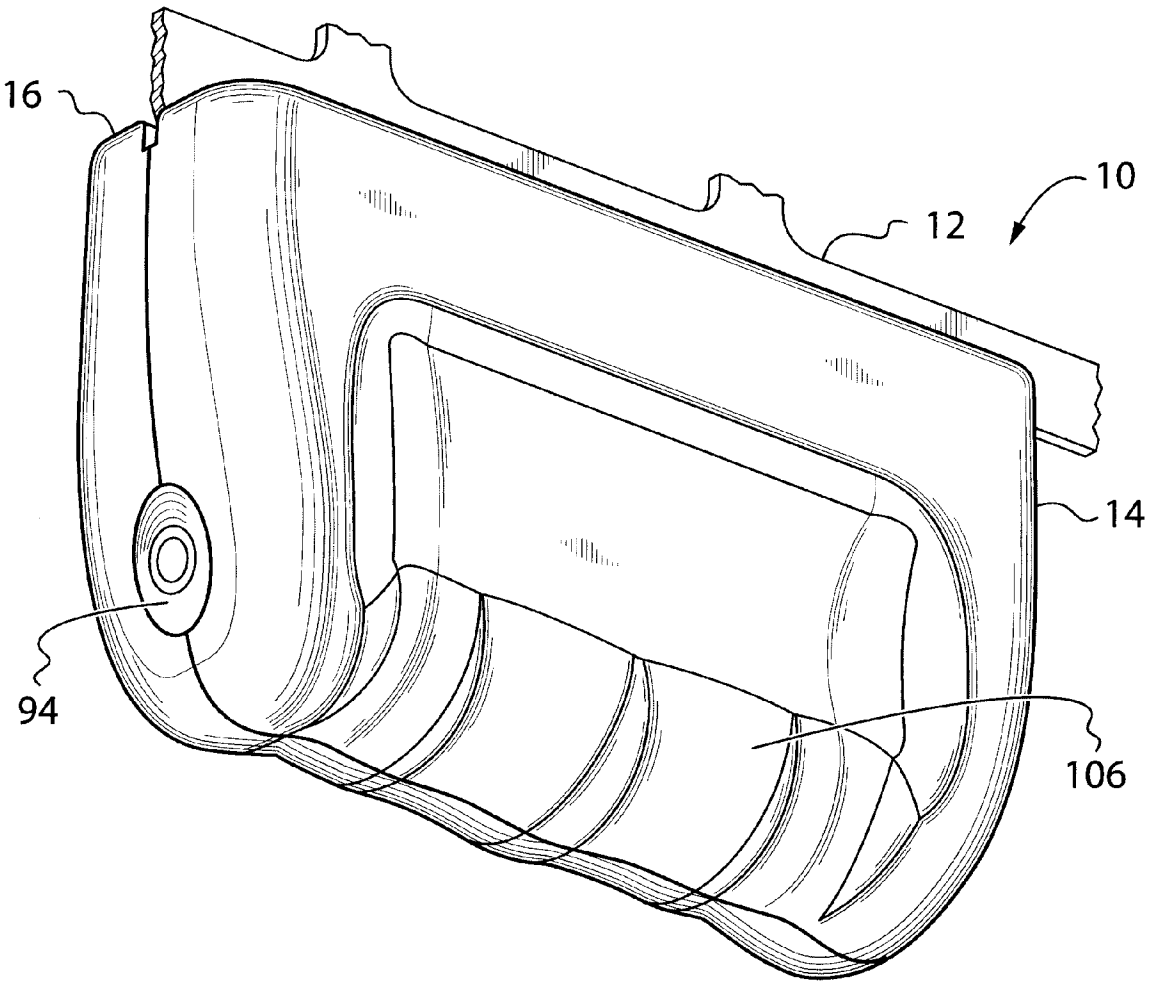
FIG. 1*a* is a perspective view of a sharpener in accordance with an embodiment of the present invention.
Figure 3:
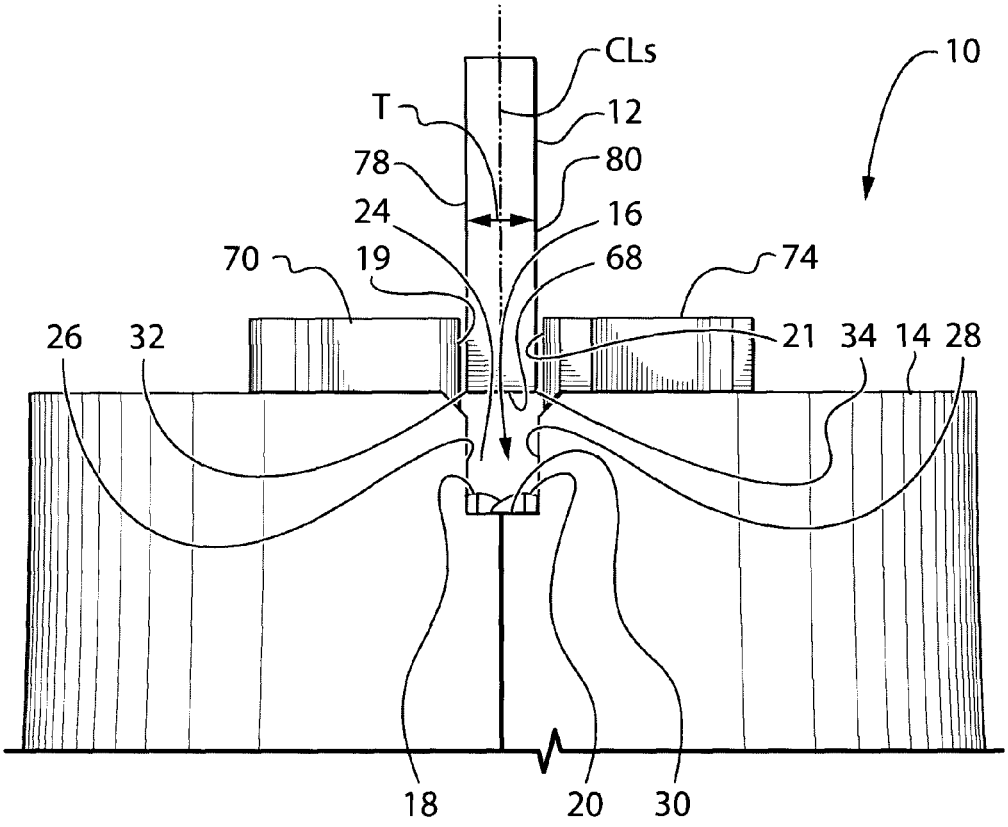
FIG. 3 is a magnified end view of the sharpener shown in FIG. 1*a;*

Reference is made to FIG. 1*a*, which shows a sharpener 10, in accordance with an embodiment of the present invention. The sharpener 10 may be used to sharpen a skate blade 12 of a skate (not shown). The sharpener 10 may also be used as a blade sharpness maintenance device, whereby it is used on the skate blade 12 prior to each trip a skater makes onto an ice surface. Referring to FIG. 3, the skate blade 12 includes a first side face 78, a second side face 80, an edge face 68, a first corner edge 32 and a second corner edge 34. For ease of illustration, only the lower portion of the skate blade 12 is shown in the figures. The skate blade 12 has a thickness T.

Figure 2:
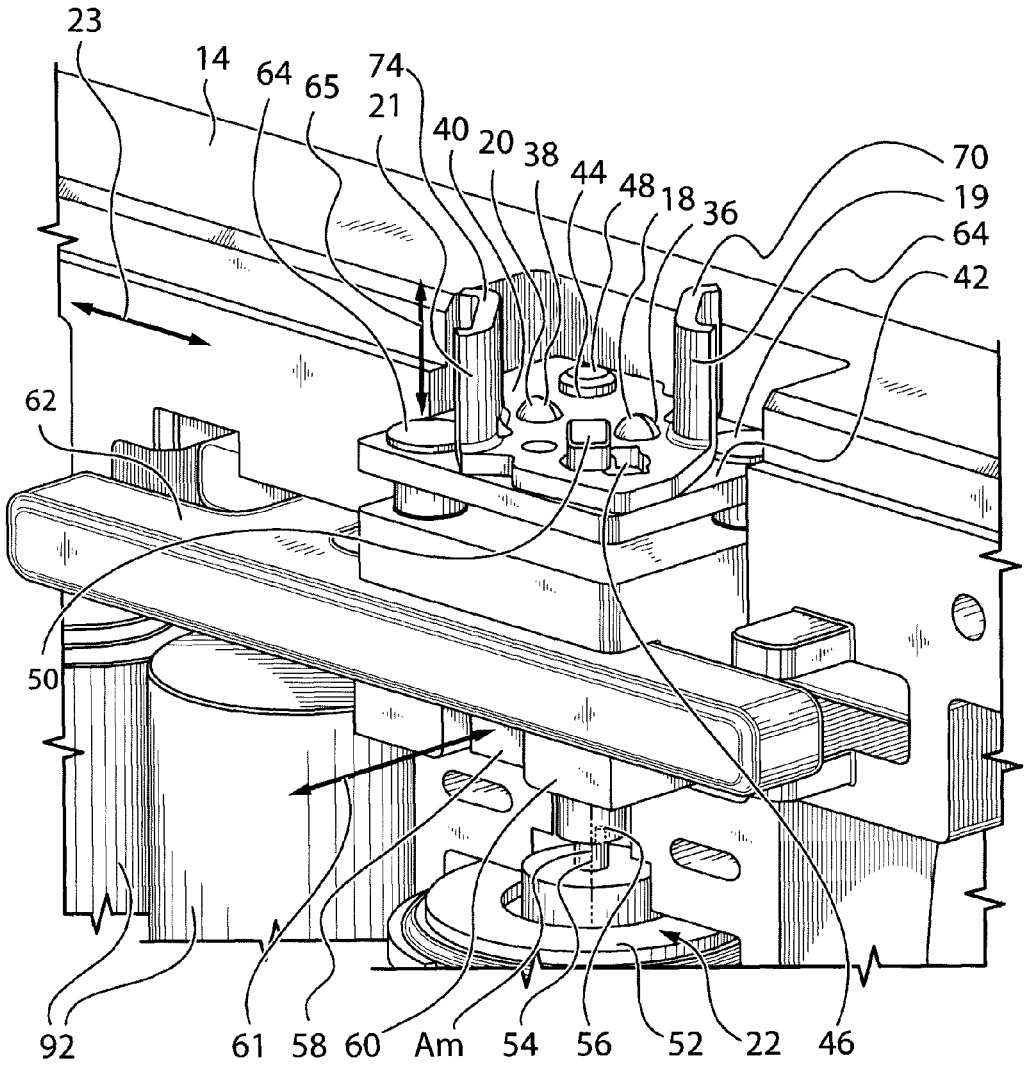
FIG. 2 is a magnified perspective view of a portion of the sharpener shown in FIG. 1*a*, which an element removed to show components hidden thereby.

Referring to FIG. 2, the sharpener 10 includes a body 14, a skate blade orienting structure 16, a first corner edge sharpening structure 17*a* for sharpening the first corner edge 32 (FIG. 6*b*), a second corner edge sharpening structure 17*b* for sharpening the second corner edge 34 (FIG. 6*b*), and a drive mechanism 22 (FIG. 2) for driving movement of the first and second corner edge sharpening structures 17*a* and 17*b* relative to the body 14.

The body 14 may be a two-piece assembly (see FIG. 1*a*), and may be made from a suitable material such as a molded plastic.

Figure 1B:
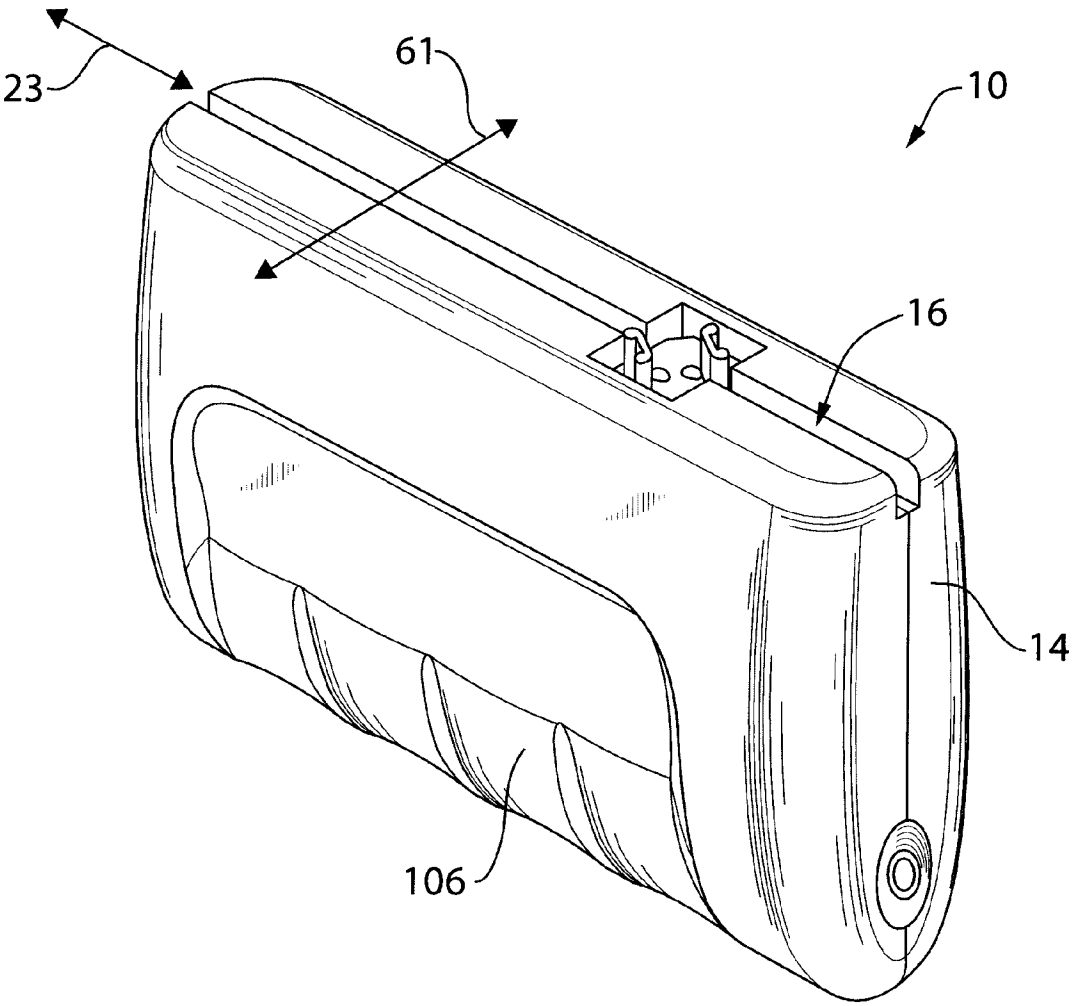
FIG. 1*b* is another perspective view of the sharpener shown in FIG. 1*a;*

Referring to FIG. 1*b*, the skate blade orienting structure 16, which in a simple incarnation is a slot 24 in the body 14, is configured to orient the skate blade 12 (FIG. 1*a*) along a selected direction line 23 relative to the first and second corner edge sharpening structures 17*a* and 17*b*. The direction line 23 may be referred to as the longitudinal direction line 23, since the orienting structure 16 sets the orientation of the longitudinal axis of the skate blade 12. A lateral direction line, shown at 61, is transverse to the longitudinal direction line 23. The skate blade orienting structure 16 also centers the skate blade 12 laterally on the first and second corner edge sharpening structures 17*a* and 17*b*.

The skate blade orienting structure 16 may have any suitable structure. For example, as shown in FIG. 3 in embodiments wherein the orienting structure 16 is the slot 24, the slot 24 has a first slot side wall 26, a second slot side wall 28 and a slot floor 30. The first and second slot side walls 26 and 28 are engageable with the first and second side faces 78 and 80 of the skate blade 12. The slot floor 30 sets the position (the height specifically) of the edge face 68 and may be referred to as an edge face positioning surface 30. Due to the concavity of the edge face 68, the slot floor 30 may engage the first and second corner edges 32 and 34 and be spaced from the edge face 68 itself.

Figure 6A:
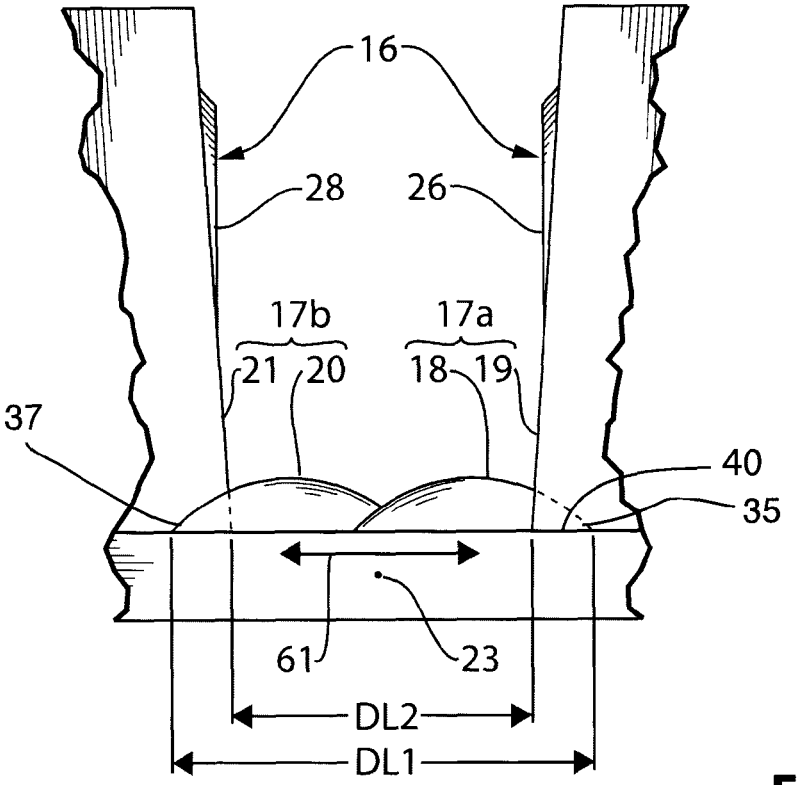
FIG. 6*a* is a highly magnified view of sharpening components of the sharpener shown in FIG. 1*a;*

Referring to FIGS. 2 and 6*a*, the first and second corner edge sharpening structures 17*a* and 17*b* are positioned on a sharpening base 40. The first corner edge sharpening structure 17*a* includes a first edge face sharpening surface 18 and a first side face sharpening surface 19. Similarly, the second corner edge sharpening structure 17*b* includes a second edge face sharpening surface 20 and a second side face sharpening surface 21.

Figure 6B:
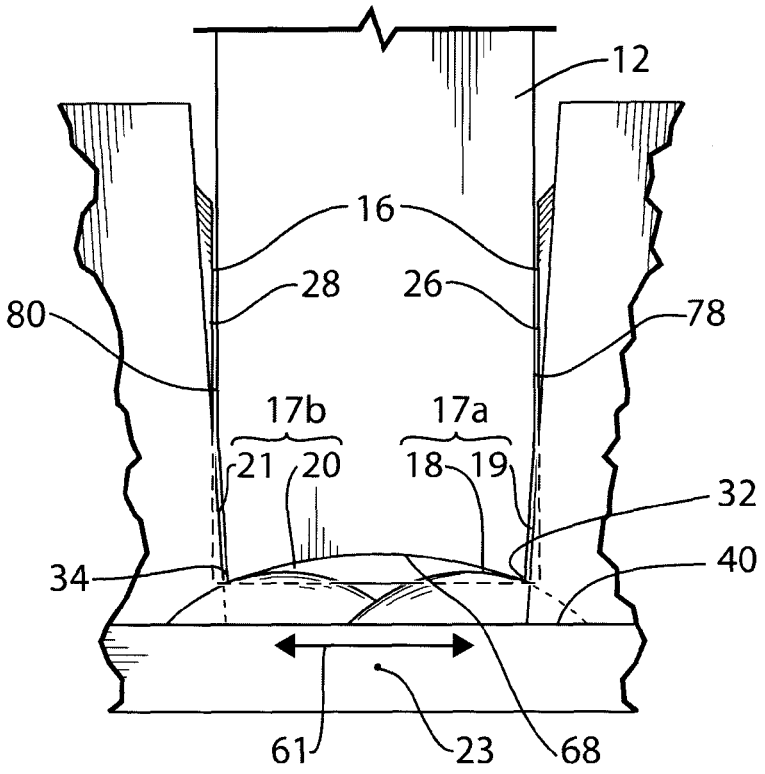
FIG. 6*b* is a highly magnified view of sharpening components of the sharpener shown in FIG. 1*a*, with a skate blade positioned thereon.

As shown in FIG. 6*b*, the first edge face sharpening surface 18 is positioned for sharpening the edge face 68 proximate the first corner edge 32, and the first side face sharpening surface 19 is positioned for sharpening the first side face 78 proximate the first corner edge 32. Similarly, the second edge face sharpening surface 20 is positioned for sharpening the edge face 68 proximate the second corner edge 34, and the second side face sharpening surface 21 is positioned for sharpening the second side face 80 proximate the second corner edge 34. The first and second edge face sharpening surfaces 18 and 20 are angled downwardly in a laterally outward direction (ie. in a lateral direction away from each other). In this way, they maintain the concavity of the edge face 68 of the skate blade 12.

With reference to FIG. 6*a*, when the sharpener 10 is viewed along the longitudinal direction line 23 (which is shown in FIG. 6*a* as a point, since the longitudinal direction line 23 is perpendicular to the plane of the view shown in that figure), the first edge face sharpening surface 18 and the first side face sharpening surface 19 appear to intersect. Similarly, the second edge face sharpening surface 20 and the second side face sharpening surface 21 appear to intersect. This is because the first and second edge face sharpening surfaces 18 and 20 have laterally outer edges, shown at 35 and 37 respectively, which are laterally outboard of the first and second side face sharpening surfaces 19 and 21 respectively, as can be clearly seen in FIG. 6*a*. As a result, as the sharpener 10 is passed along the length of the skate blade 12 (FIG. 6*b*), the sharpening surfaces 18, 19, 20 and 21 cooperate to provide relatively sharp first and second corner edges 32 and 34.

As shown in FIGS. 6*a* and 6*b*, the first and second side face sharpening surfaces 19 and 21 may be sloped laterally towards each other slightly (eg. by one degree from vertical) and the lower portions of these sharpening surfaces 19 and 21 are inboard of the slot side walls 26 and 28, so that they are ensured of engagement with the first and second side walls. Note that some of the relative sizes of selected elements shown in FIGS. 6*a* and 6*b* may be exaggerated for visual clarity, however, these figures are not to be interpreted as being to scale.

The sharpening surfaces 18, 19, 20 and 21 may be made in any suitable way. For example, they may be covered with an abrasive material such as diamond, or Cubic Boron Nitride (CBN).

Figure 9:
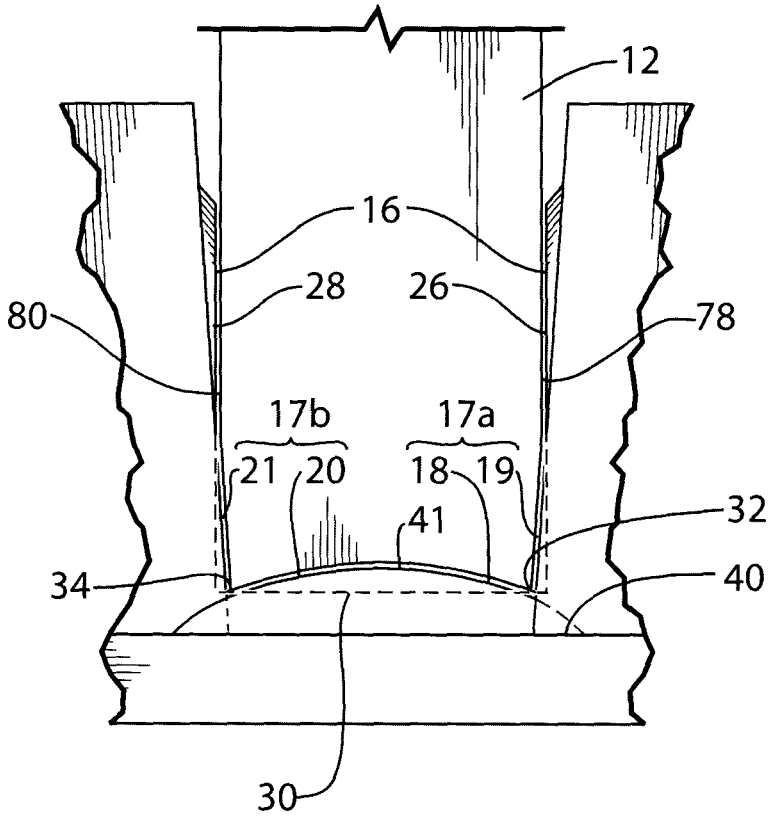
FIG. 9 is a highly magnified view of alternative sharpening components for the sharpener shown in FIG. 1*a*, with a skate blade positioned thereon.

As shown more clearly in FIG. 2, the first and second edge face sharpening surfaces 18 and 20 may be surfaces on separate first and second bosses 36 and 38 respectively on the sharpening base 40. It is alternatively possible for the first and second edge face sharpening surfaces 18 and 20 to be portions of a surface of a single large boss or similar feature, as shown at 41 in FIG. 9. The embodiment shown in FIG. 9, permits the sharpener 10 to be used to sharpen a skate blade 12 outright, since it is capable of forming the entire concave surface of the edge face 68 of the skate blade 12, whereas the embodiment shown in FIG. 2 with two smaller, separate bosses 36 and 38 are preferably used to maintain the sharpness of the corner edges 32 and 34.

The first and second side face sharpening surfaces 19 and 21 may be on first and second side face sharpening structures 70 and 74 respectively, which are also on the sharpening base 40.

The sharpening base 40 may be made removable from the rest of the sharpener 10 so that it can be replaced with a new sharpening base 40 when it wears out and is no longer effective. Thus, the sharpening base 40 may be considered to be a disposable part of the sharpener 10, and the rest of the sharpener 10 may be considered to be non-disposable, at least in some embodiments.

The sharpening base 40 may removably lock into a base support 42, by any suitable connecting structure. For example, the sharpening base 40 may include a first and second apertures 44 and 46, which receive first and second pins 48 and 50 on the base support 42. The first aperture 44 may be circular and the first pin 48 may be circular. The second aperture 46 is a keyhole slot, and the second pin 50 is a T-pin (ie. it is T-shaped). To mount the sharpening base 40 onto the base support 42, the sharpening base 40 is pushed down so that the pins 48 and 50 pass through the apertures 44 and 46. The sharpening base 40 is then rotated to lock the T-pin 50 into the narrower part of the keyhole slot 46. It will be understood that it is alternatively or additionally possible for the first aperture 44 to be a keyhole slot and for the first pin 48 to be T-shaped.

It will be noted that the sharpening base 40 is relatively small and may be made from a suitable plastic that is easily moldable and is relatively inexpensive or from an inexpensive grade of steel that can be stamped or from a powdered metal. Additionally, the sharpening base 40 can be, as shown, relatively easily removable from and installable onto the base support 42.

The base support 42 is driven by the drive mechanism 22. The drive mechanism 22 includes a motor 52 with an output shaft 54 which has an offset drive member 56 thereon that is offset from the output shaft axis, shown at Am. The drive mechanism 22 further includes a first driven member 58 and a second driven member 60. The first driven member 58 is slidably mounted to the second driven member 60. The second driven member 60 is configured to restrict the first driven member 58 to only have freedom of movement approximately along the transverse direction line 61. The second driven member 60 is slidably mounted on a carriage 62 and is restricted by the carriage 62 to only have freedom of movement approximately along sliding movement approximately along the longitudinal direction line 23.

Rotation of the motor output shaft 54 causes the offset drive member 56 to 'orbit' about the motor output shaft axis Am. This orbiting path causes the first driven member 58 to move in the orbiting (ie. circular path). This circular path results in transverse displacement and longitudinal displacement. Because of the freedom of movement of the first driven member transversely relative to the second driven member, the transverse displacement of the first driven member 58 does not drive any transverse movement of the second driven member. However, because the first driven member 58 does not have freedom of movement longitudinally relative to the second driven member 60, the longitudinal displacement of the first driven member 58 drives longitudinal displacement of the second driven member 60. Thus, the second driven member 60 reciprocates along the longitudinal direction line 23.

The second driven member 60 supports the base support 42. Thus, operation of the drive mechanism 22 generates reciprocation of the base support 42, and therefore the sharpening surfaces 18, 19, 20 and 21 along a reciprocation path along the longitudinal direction line 23.

Figure 4:
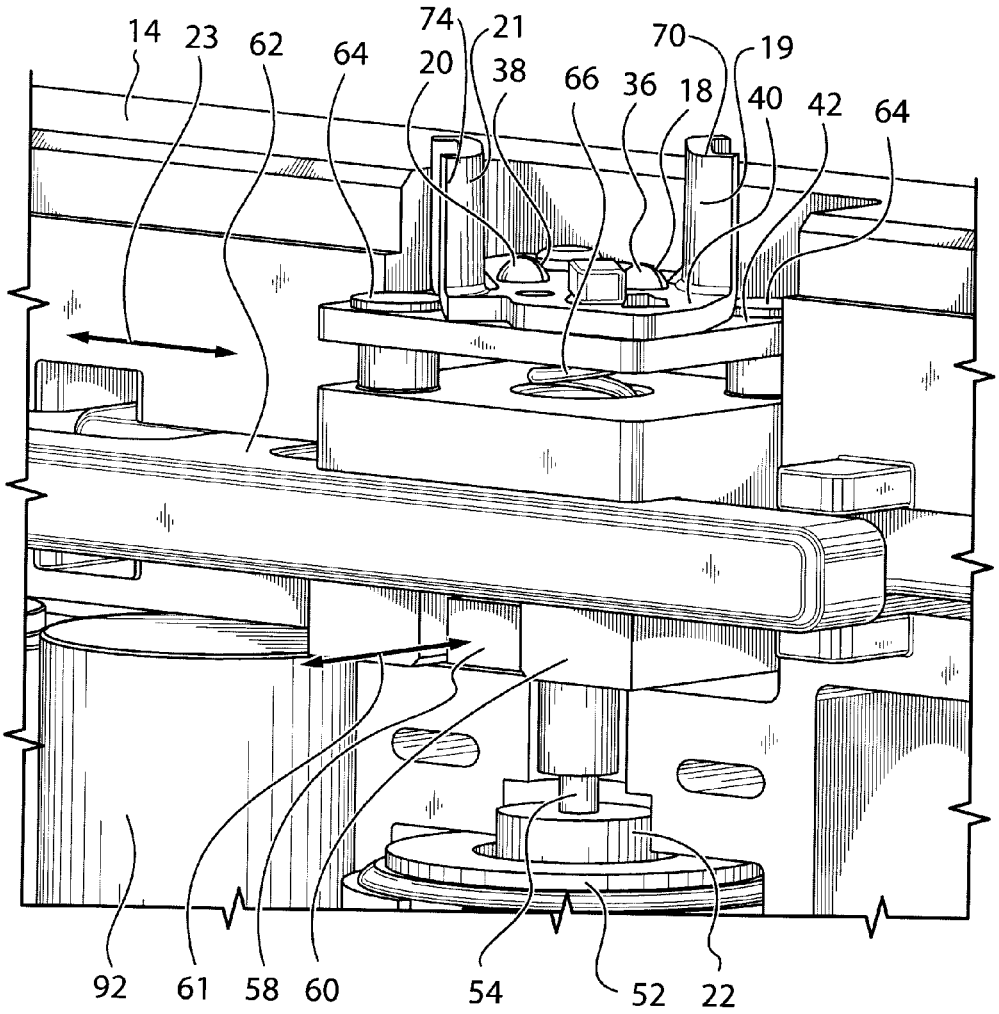
FIG. 4 is another magnified perspective view of the portion of the sharpener shown in FIG. 2.

The second driven member 60 has two slide bars 64 thereon, which hold the base support 42 and support sliding of the base support 42 along a third direction line 65 that is transverse to the edge face positioning surface 30. The third direction line 65 is vertical when the sharpener 10 is oriented as shown in FIG. 2. A biasing member 66, shown in FIG. 4, biases the base support 42 towards the edge face positioning surface 30 and therefore urges the sharpening surfaces 18 and 20 to engage the edge face 68 (FIG. 3), of the skate blade 12 when the skate blade 12 is positioned on the edge face positioning surface 30. The biasing member 66 (FIG. 4) may be referred to as a sharpening surface engagement biasing member, since it biases the sharpening surfaces 18, 19, 20 and 21 towards engagement with the skate blade 12, or alternatively a sharpening structure engagement biasing member since it biases the sharpening structures 17*a* and 17*b* towards engagement with the snow/ice travel member, which may be, for example, the skate blade 12. The sharpening surface engagement biasing member 66 may be any suitable type of biasing member, such as a compression spring.

It should be noted that in FIGS. 1 and 3, the skate blade 12 is not shown in engagement with the edge face positioning surface 30. Also, it should be noted that, as shown in FIG. 3, the sharpening surfaces 18, 19, 20 and 21 are urged by the sharpening surface engagement biasing member 66 to a rest position that is past the edge face positioning surface 30. Thus, when the skate blade 12 is positioned on the edge face positioning surface 30, the sharpening surface engagement biasing member 66 is compressed by a certain amount, and therefore urges the sharpening surfaces 18, 19, 20 and 21 into engagement with the skate blade 12 with a selected force, regardless of how hard a user pushes the skate blade 12 into the slot 24. In this way, even when the force of engagement between the skate blade 12 and the slot 24 varies, the force that is exerted between the sharpening heads 18 and 20 and the skate blade 12 remains consistent.

Figure 5:
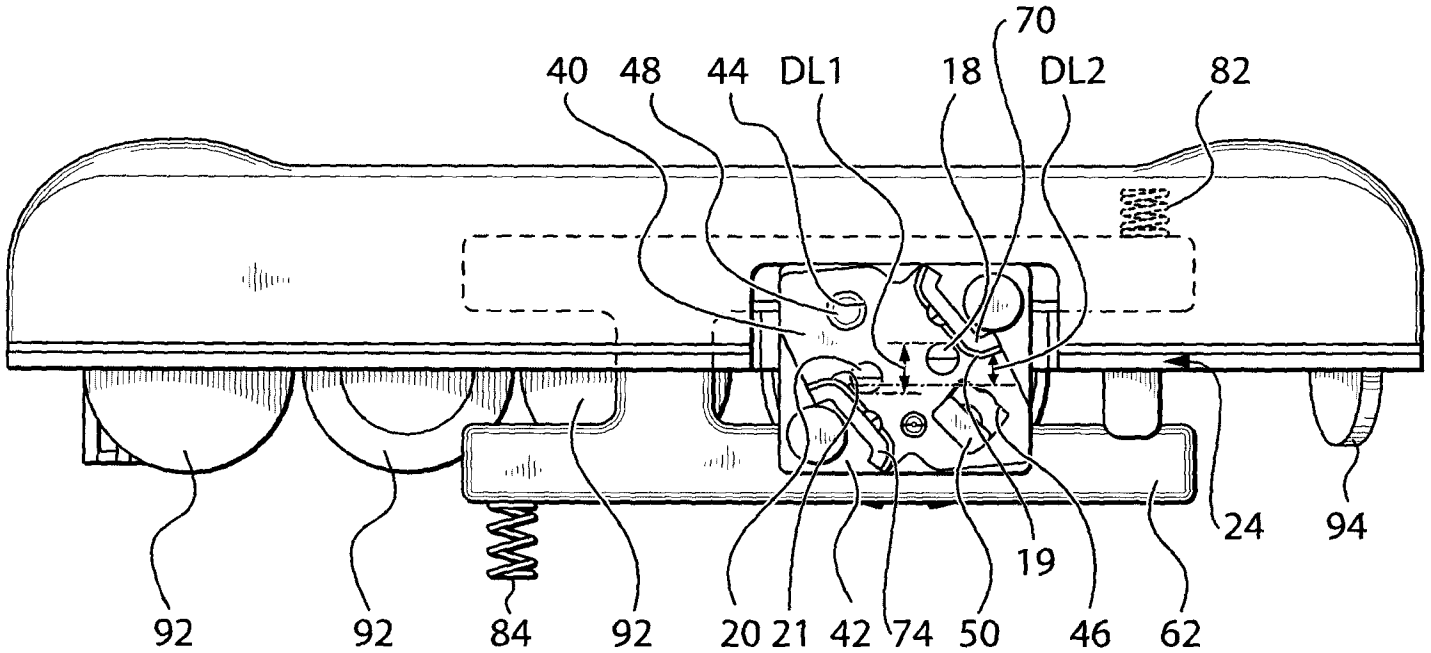
FIG. 5 is a top plan view of the sharpener shown in FIG. 1*a*, with an element removed to shown components hidden thereby.

Referring to FIGS. 5, 6*a* and 6*b*, the first and second edge face sharpening surfaces 18 and 20 are spaced apart by a first lateral spacing DL1. The first and second side face sharpening surfaces 19 and 21 are spaced apart by a second lateral spacing DL2, which is less than the lateral spacing DL1.

Figure 7B:
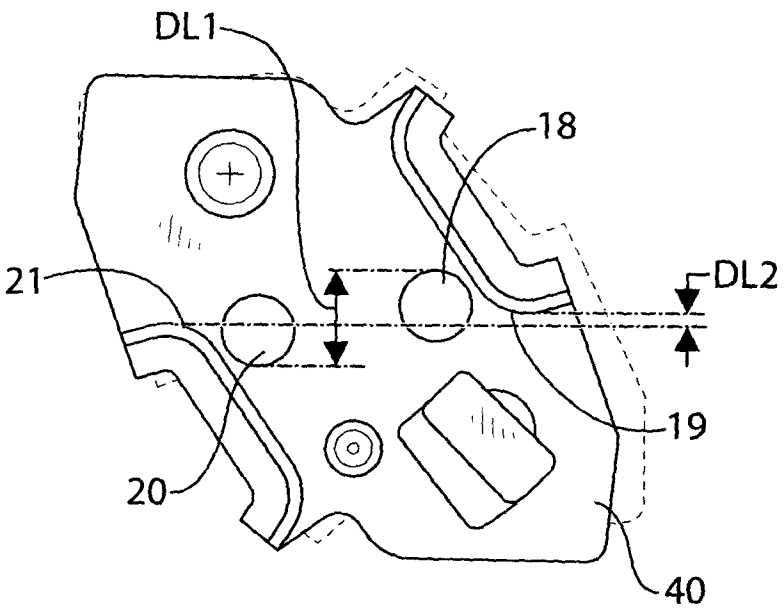
FIGS. 7*a* and 7*b* are plan views of two rotational positions for the sharpening components shown in FIGS. 6*a* and 6*b;*
Figure 7A:
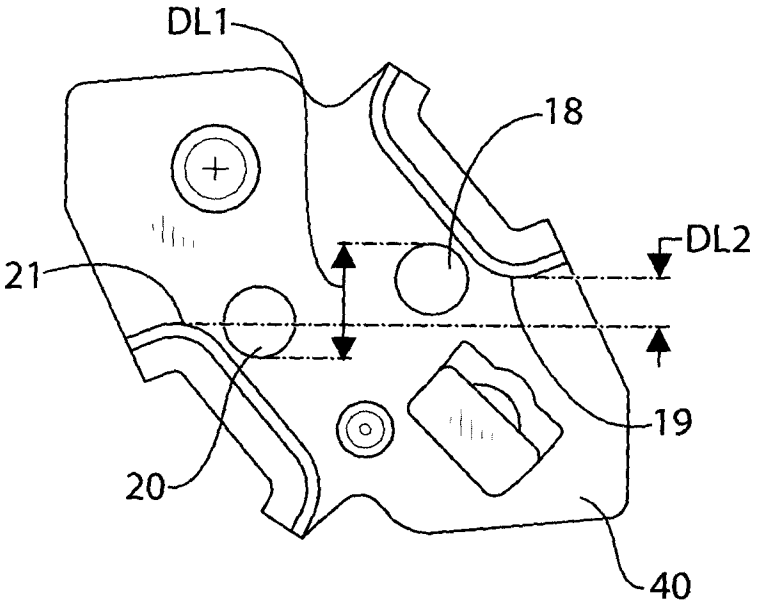

Referring to FIG. 5, the size of the slot 24 (only part of which is shown in FIG. 5 since a portion of the body 14 has been omitted), and the relative positions of the sharpening surfaces 18, 19, 20 and 21 (which determine the lateral spacings DL1 and DL2) determine the thickness T (FIG. 3) of skate blade 12 that can be sharpened. The sharpener 10 may advantageously be configured to accommodate a range of thicknesses T of skate blades 12. For this purpose, the sharpening base 40 may be rotated through a range of positions, which changes the lateral spacings DL1 and DL2, as shown in the two exemplary positions of the sharpening base 40 in FIGS. 7*a* and 7*b*. As a result of the clockwise rotation of the sharpening base 40 from the position shown in FIG. 7*a* to the position shown in FIG. 7*b*, the lateral spacings DL1 and DL2 have both been reduced. As a result, rotation of the sharpening base 40 from the position shown in FIG. 7*a* to the position shown in FIG. 7*b* decreases the thickness of skate blade that it is positioned to sharpen. Similarly rotation of the sharpening base 40 in the counterclockwise direction from the position shown in FIG. 7*b* to the position shown in FIG. 7*a* increases the thickness of skate blade 12 (FIG. 6*b*) that it is positioned to sharpen. Thus, the sharpening base 40 may be rotatable to adjust the relative positions of the sharpening surfaces 18, 19, 20 and 21 so as to control the thickness of skate blade 12 that can be sharpened.

Referring to FIG. 5, to carry out the rotation of the sharpening base 40 the carriage 62 may be movable relative to the body 14. A first carriage biasing member 82, and a second carriage biasing member 84, both shown in FIG. 5, bias the carriage 62 clockwise in the view shown in FIG. 5, which biases the sharpening surfaces 18, 19, 20 and 21 towards having reduced lateral spacings DL1 and DL2.

The carriage biasing members 82 and 84 therefore drive the first and second side face sharpening surfaces 19 and 21 into engagement with the skate blade 12, at least over a working range of adjustability. When a relatively thicker skate blade 12 is introduced into the sharpener 10, the sharpening base 40 is rotated in a direction (counterclockwise in the view shown in FIG. 5) that increases the spacings DL1 and DL2. As a result of the rotation of the sharpening base 40 to accommodate the thicker skate blade 12, the carriage 62 is rotated against the biasing of the carriage biasing members 82 and 84. The carriage biasing members 82 and 84 may be referred to as side face sharpening surface engagement biasing members 82 and 84 since they bias the side face sharpening surfaces 19 and 21 into engagement with the skate blade 12.

In order that the shape of the cut in the skate blade 12 provided by the first and second edge face sharpening surfaces 18 and 20 is consistent across a range of rotational positions of the sharpening base 40, the sharpening surfaces 18, 19, 20 and 21 are preferably solid revolutions of profiles at least partway about their own individual axes. It is optionally possible, however, for the sharpening surfaces 18 and 20 to have shapes that are not solid revolutions.

It will be noted that the rotation of the carriage 62 when accommodating thicker skate blades 12 means that the carriage 62 may not initially be oriented strictly longitudinally (ie. precisely along the longitudinal direction line 23) when a thicker skate blade 12 is inserted into the slot 24. Notwithstanding the misalignment of the carriage 62 with respect to the longitudinal direction line 23, the skate blade 12 itself prevents the movement of the sharpening base 40 and therefore the second driven member 60 along a line other than the longitudinal direction line 23. To permit such movement, the biasing members 82 and 84 permit the carriage 62 to float sufficiently during the reciprocation of the sharpening base 40 and second driven member 60.

In an alternative embodiment the sharpening base 40 could be rotatable relative to the second driven member 60 to accommodate skate blades 12 of different thicknesses. In such an alternative embodiment the carriage 62 could be fixedly aligned longitudinally within the body 14 (such as the embodiment shown in FIG. 19) and the biasing members 82 and 84 could be omitted.

Figure 8:
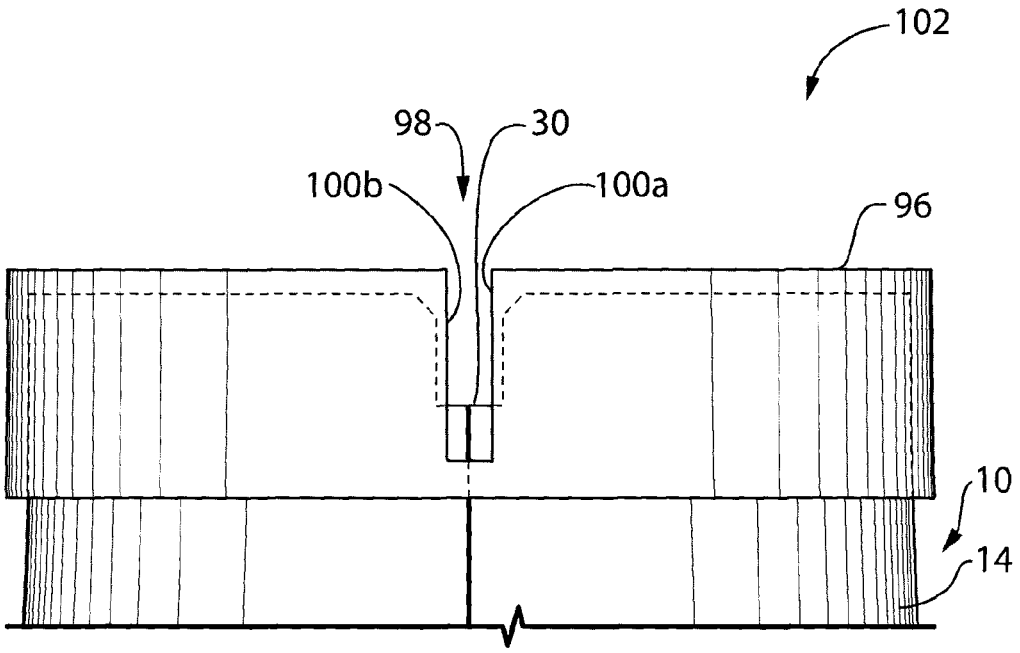
FIG. 8 is an end view of the sharpener shown in FIG. 1*a* with an optional shoe for accommodating a skate blade having a different thickness.

In order to accommodate a plurality of skate blade thicknesses T the sharpener 10 may further include a plurality of shoes 96 (FIG. 8) that are each sized to hold a different thickness of skate blade 12. Each shoe 96 would fit on the body 14, and would have an open-bottom slot 98 therein, which has first and second slot side walls 100*a* and 100*b* which define an opening for a skate blade 12 having a selected thickness T and which together form a skate blade orienting structure. By having the slot 98 be open-bottomed, the skate blade 12 is permitted to engage the edge face positioning surface 30 so that the same force is applied by the sharpening surfaces 18, 19, 20 and 21 on the skate blade 12 whether or not a shoe 96 is used. A kit of parts 102 may be provided that includes the sharpener 10 and at least one shoe 96 having a slot width that is different from the slot width of the slot 24 (and preferably a plurality of interchangeable shoes 96 of different slot widths) to accommodate a variety of skate blade thicknesses. The at least one shoe 96 and the sharpener 10 together include a plurality of skate blade orienting structures (eg. the slots 24 and 98) wherein each skate blade orienting structure is configured for orienting a skate blade having a unique width along a longitudinal direction line and for centering the skate blade 12 laterally with respect to the edge face sharpening surfaces 18 and 20. It is optionally possible in embodiments wherein a plurality of shoes 96 are provided, that the sharpener 10 itself need not include a slot that constitutes a skate blade orienting structure. In such an embodiment, all the skate blade orienting structures could be provided by slots 98 in the plurality of shoes 96.

It will be noted that it is at least possible to provide an embodiment of the invention wherein the first and second side face sharpening surfaces 19 and 21 are not provided. It is also possible to provide an embodiment of the invention wherein the first and second side face sharpening structures 70 and 74 with the sharpening surfaces 19 and 21 thereon are replaced with first and second side face guide structures, with first and second side face guide surfaces that guide the bottom-most portion of the skate blade 12 to ensure that it is centered on the first and second edge face sharpening surfaces 18 and 20. In such an alternative embodiment, the first and second side face guide surfaces may be similar to the first and second side face sharpening surfaces 19 and 21, except that they would not contain abrasive material. It will further be noted that even if the first and second side face sharpening surfaces 19 and 21 are provided, and therefore contain abrasive material, they nonetheless also act as first and second side face guide surfaces to center the skate blade 12 on the first and second edge face sharpening surfaces 18 and 20.

Referring to FIG. 2, the motor 52 may be powered by any suitable source, such as by one or more batteries 92. Alternatively or additionally, the sharpener 10 may include a connector (eg. a plug) for plugging into an A/C source, such as a wall outlet (not shown).

A switch shown at 94 in FIG. 1*a* may be provided to turn the skate sharpener 10 on. The switch 94 may need to be depressed by the user at all times the sharpener 10 is to be operated, such that once the user lets go of the switch 94, the switch 94 is urged to an 'off' position preventing current flow to the motor 52.

In use, a user turns on the sharpener 10, and may hold the gripping surface shown at 106 (FIG. 1*a*) on the body 14, and passes the sharpener 10 along the edge face 68 of the skate blade 12 so that the sharpening surfaces 18 and 20 are able to reciprocate along their reciprocation path (which may be just a few millimeters in at least some embodiments), along the entire length of the edge face 68 of the skate blade 12.

Figure 10:
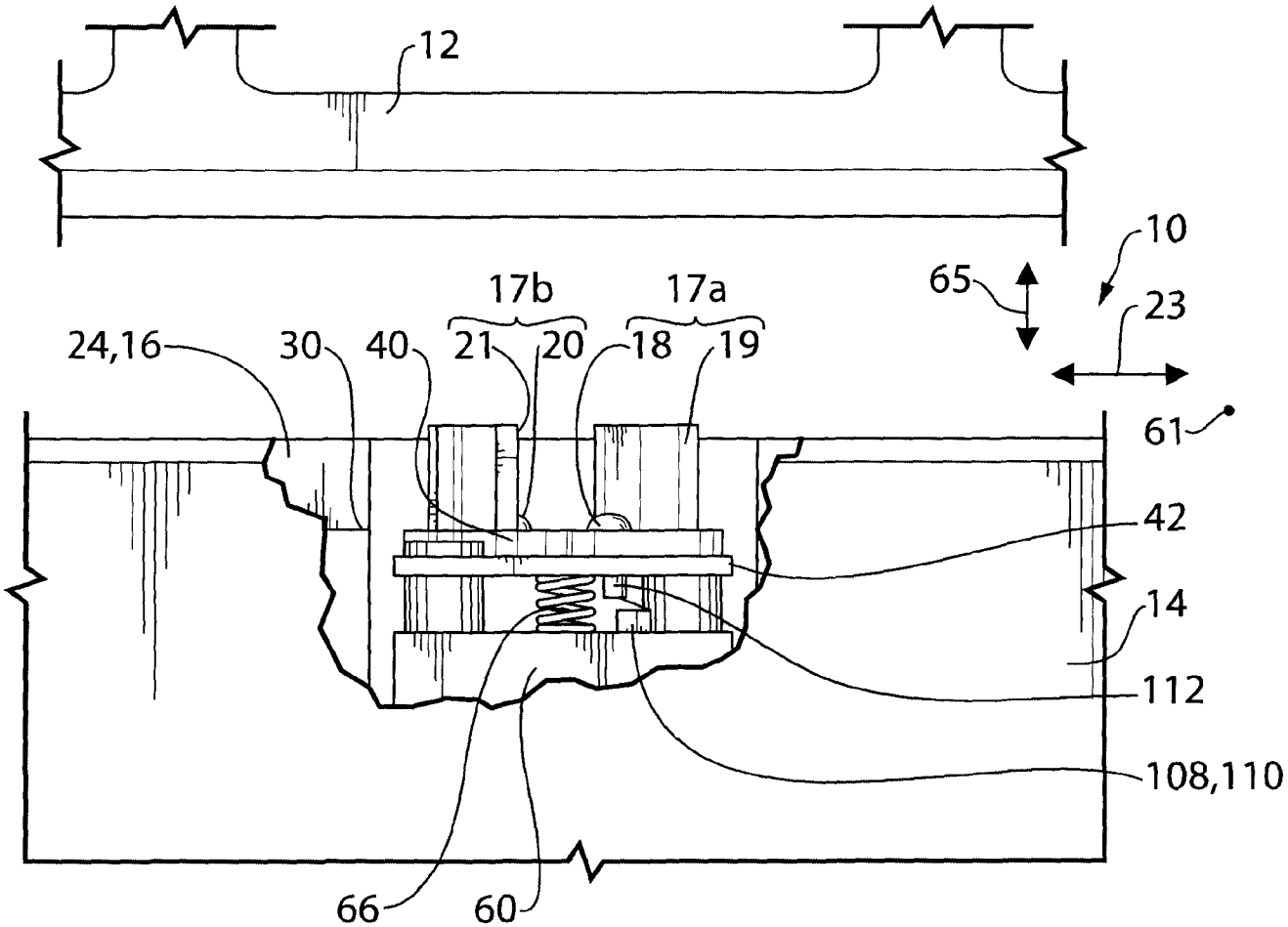
FIG. 10 is a side view of the sharpener shown in FIG. 1*a*, with an optional item engagement sensor.

Reference is made to FIG. 10, which shows the sharpener 10 with an optional item engagement sensor 108 that is configured to detect whether the user has inserted a skate blade 12 into the sharpener 10 for sharpening. The item engagement sensor 108 may have any suitable structure. For example, the item engagement sensor 108 may be a switch 110 that is closed by a projection 112 on the base support 42 when the skate blade 12 is engaged with the sharpening structures 17*a* and 17*b* and moves the sharpening base 40 downwards against the force of the sharpening surface engagement biasing member 66.

Figure 11:
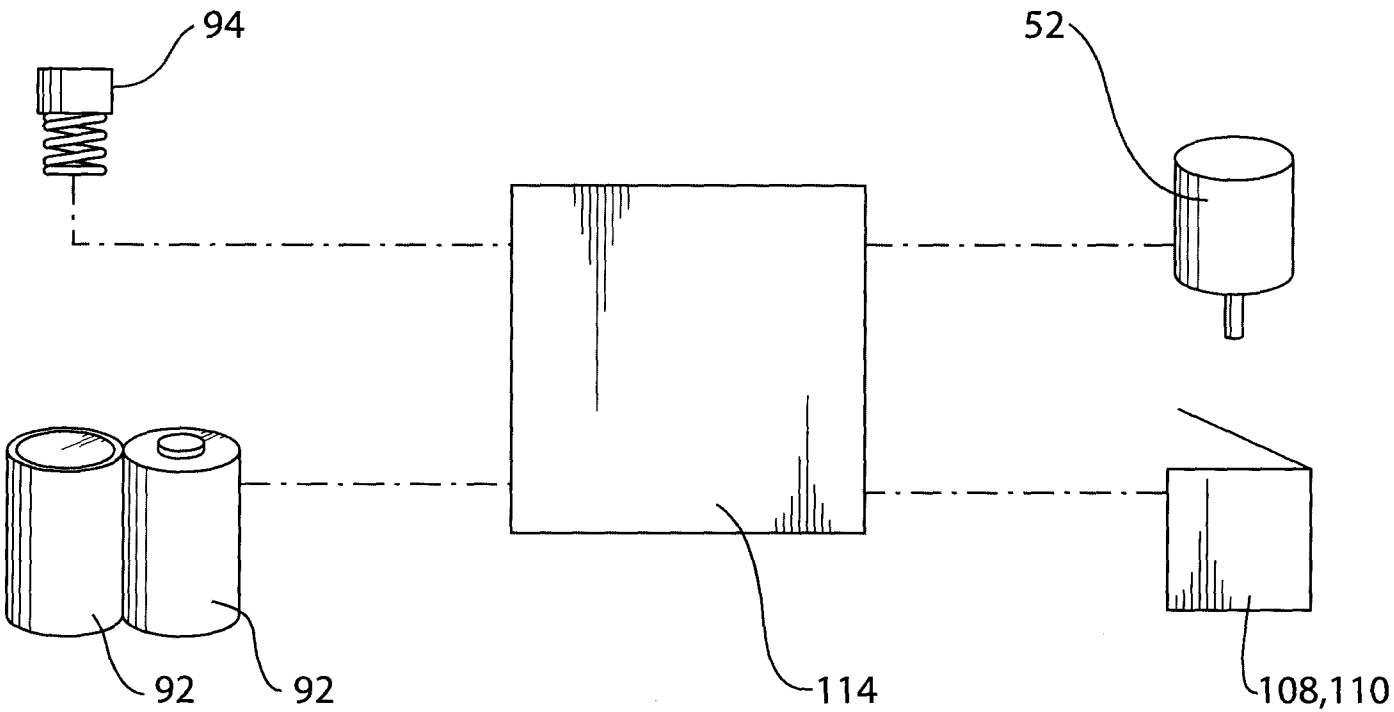
FIG. 11 is a diagram of selected electrical components from the sharpener shown in FIG. 10.

Referring to FIG. 11, the switch 110 may communicate with a controller 114 that controls the operation of the motor 52. As an example, the controller 114 may prevent operation of the motor 52 if the switch 110 is open (indicating that a skate blade 12 is not present), so as to conserve energy in the batteries 92. Therefore, if the button 94 is in the 'on' position (eg. it is depressed by a user), the controller 114 may disconnect power to the motor 52 in the event that the switch 110 is open. Furthermore, the controller 114 may send power to the motor 52 if the button 94 is 'on' and the switch 110 is closed (indicating that a skate blade 12 (FIG. 10) is engaged and seated fully on the sharpening base 40).

With continued reference to FIG. 11, in another embodiment the switch 94 may be omitted. For example, the controller 114 may send power to the motor 52 automatically if the switch 110 is closed, and may automatically disconnect power to the motor 52 if the switch 110 is opened. Thus, the operation of the motor 52 may be automated.

Figure 12:
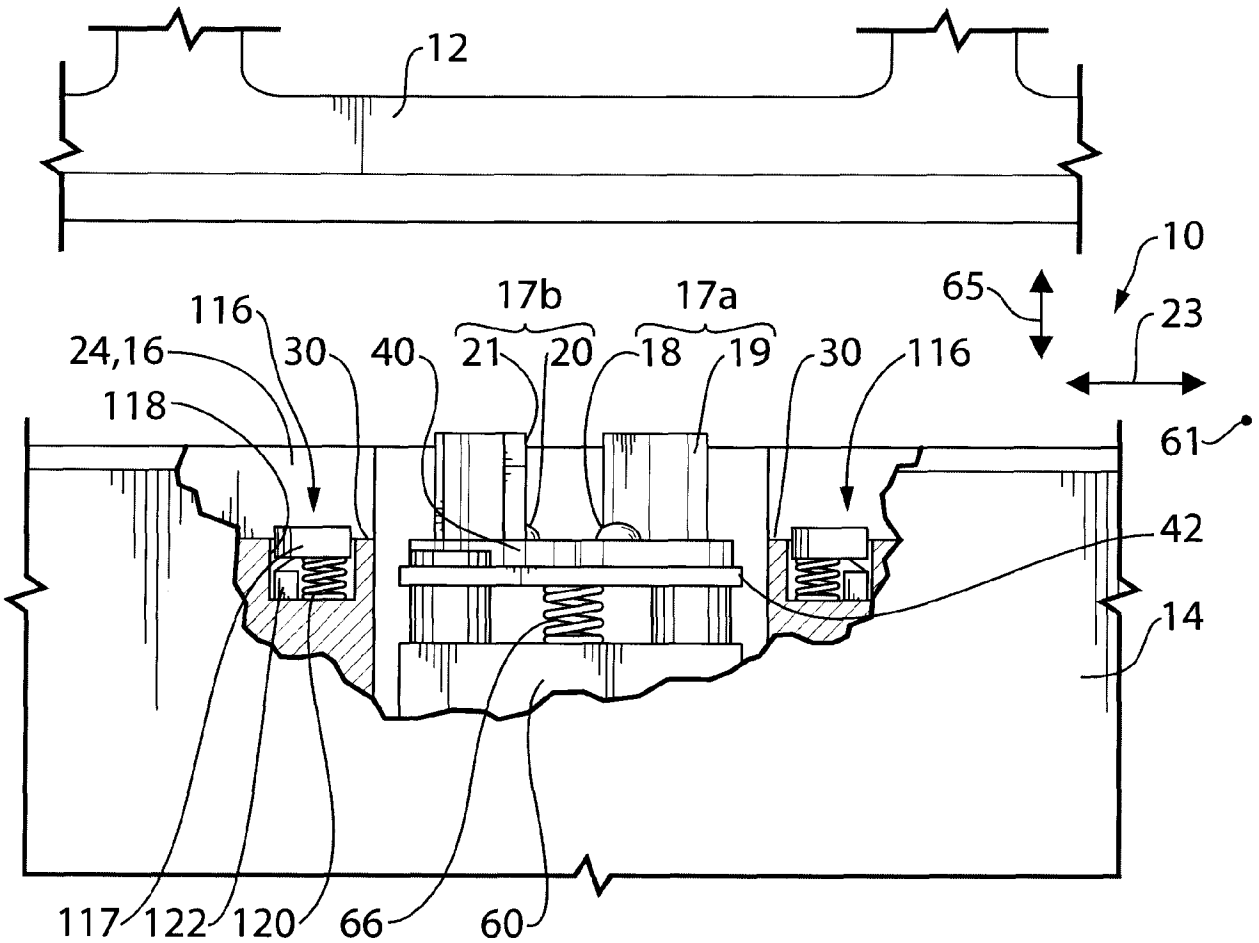
FIG. 12 is a side view of the sharpener shown in FIG. 1*a*, with two optional item engagement sensors.
Figure 13:
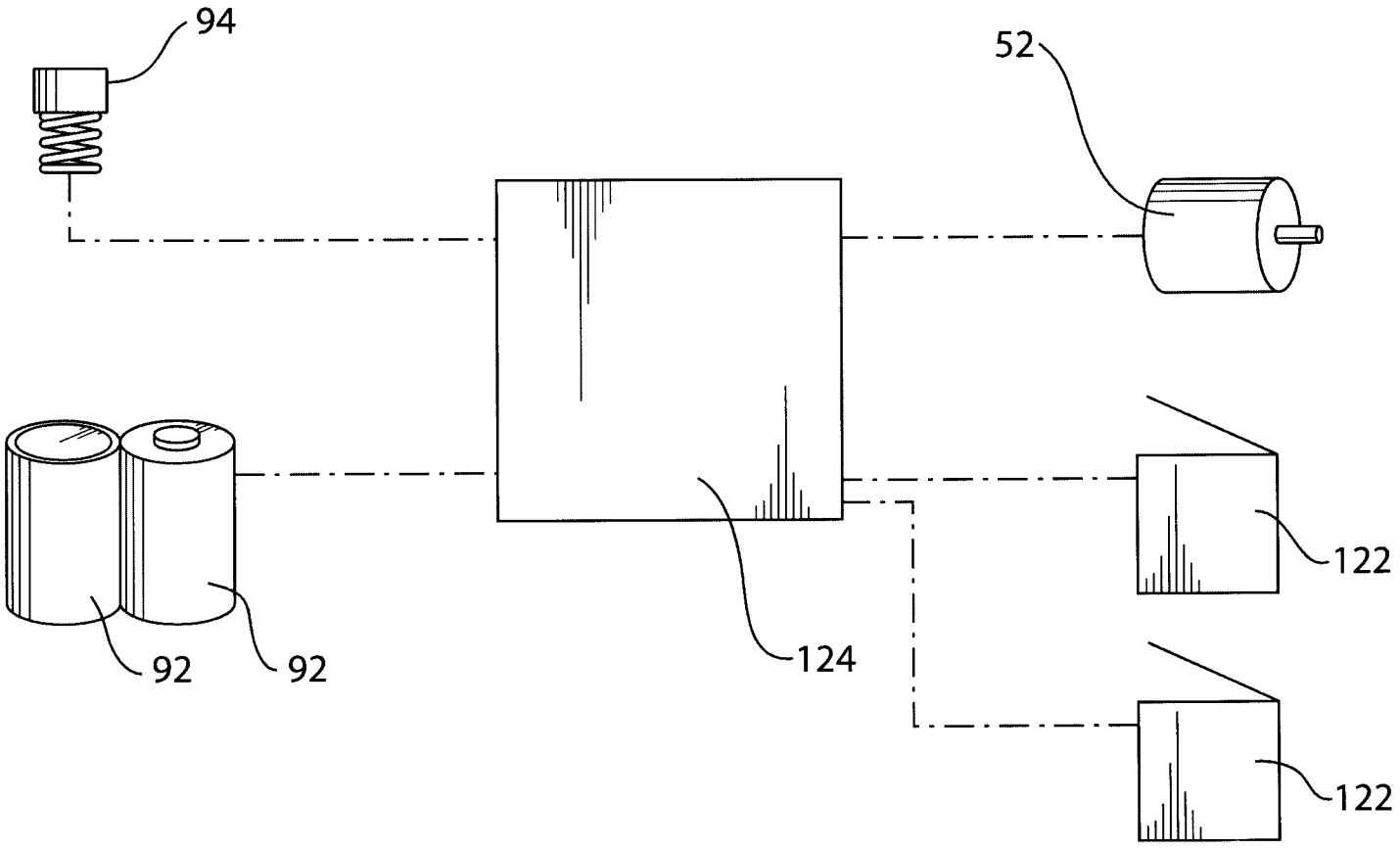
FIG. 13 is a diagram of selected electrical components from the sharpener shown in FIG. 12.

Reference is made to FIG. 12, which shows the sharpener 10 with two item engagement sensors 116. In the embodiment shown in FIG. 12, the item engagement sensors 116 may be positioned in the slot 24 ahead of and behind the sharpening base 40. Each item engagement sensor 116 may include a button 117 that is slidable in a button-receiving aperture 118 in the slot floor 30, a biasing member 120 and a switch 122. The biasing member 120 urges the button 117 to project from the slot floor 30. Placement of the skate blade 12 on the slot floor 30 depresses the buttons 117 causing closure of the switches 122. Closure of both switches 122 signals a controller 124 (FIG. 13) to permit operation of the motor 52. Similarly to the embodiment shown in FIG. 11, the controller 124 may disconnect power to the motor 52 if one or both of the switches 122 is open, and may optionally send power to the motor 52 if both switches 122 are closed and the button 94 is in the 'on' position. Alternatively, the controller 124 may automatically control the stopping and starting of the motor 52 based on whether both switches 122 are closed, such that the button 94 may be omitted.

By incorporating a sensor 116 on each side of the sharpening base 40 and requiring both switches 122 to be closed to permit operation of the motor 52, the user is encouraged to hold the skate blade 12 flat in the slot 24 and not to rock the skate blade 12 as it is moved forwards and backwards in the slot 24. When the skate blade 12 is held flat in the slot 24 and triggers both switches 122, the skate blade 12 is properly engaged with the sharpening structures 17*a* and 17*b*.

Figure 14:
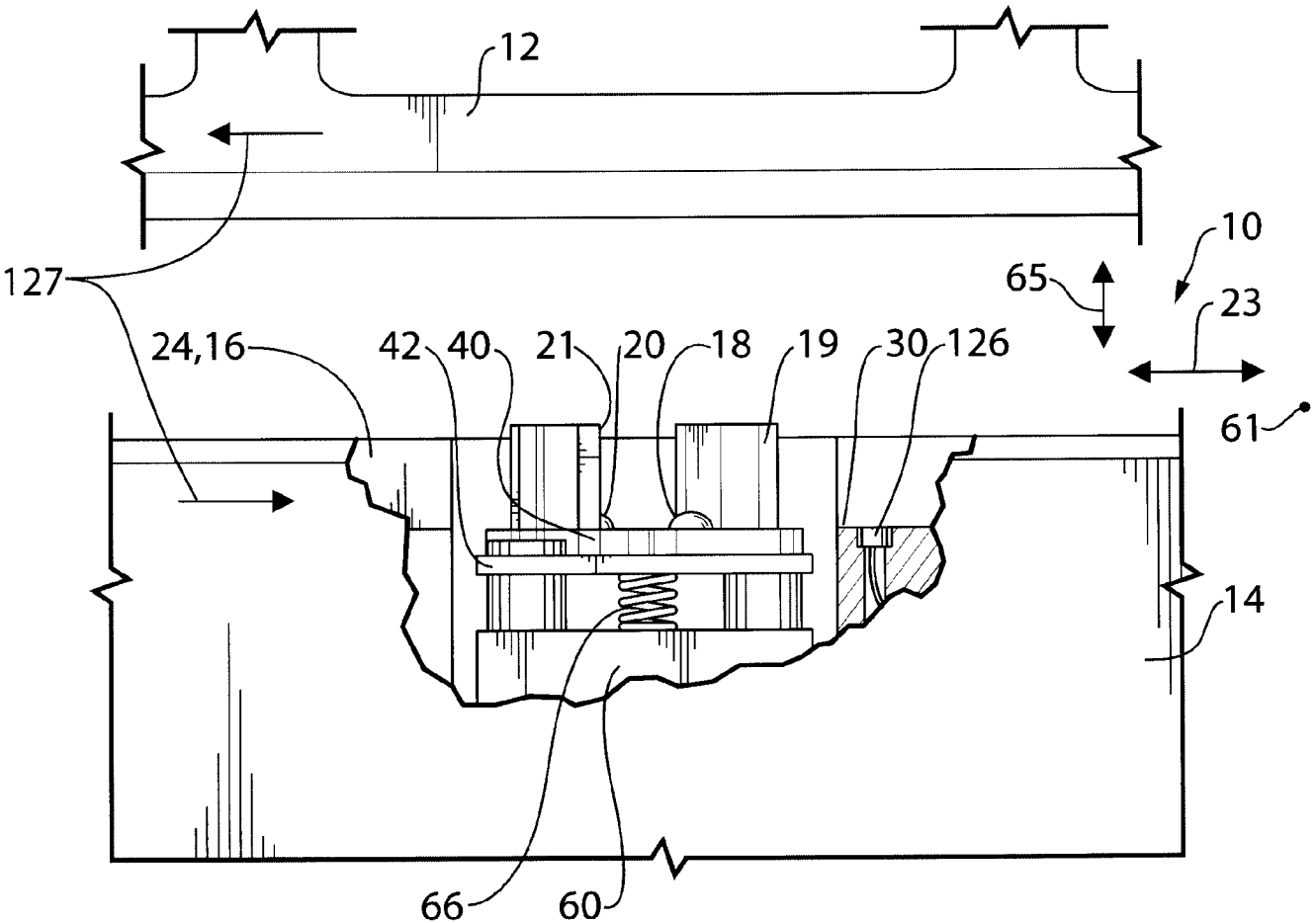
FIG. 14 is a side view of the sharpener shown in FIG. 1*a*, with an optional item imperfection sensor.
Figure 15:
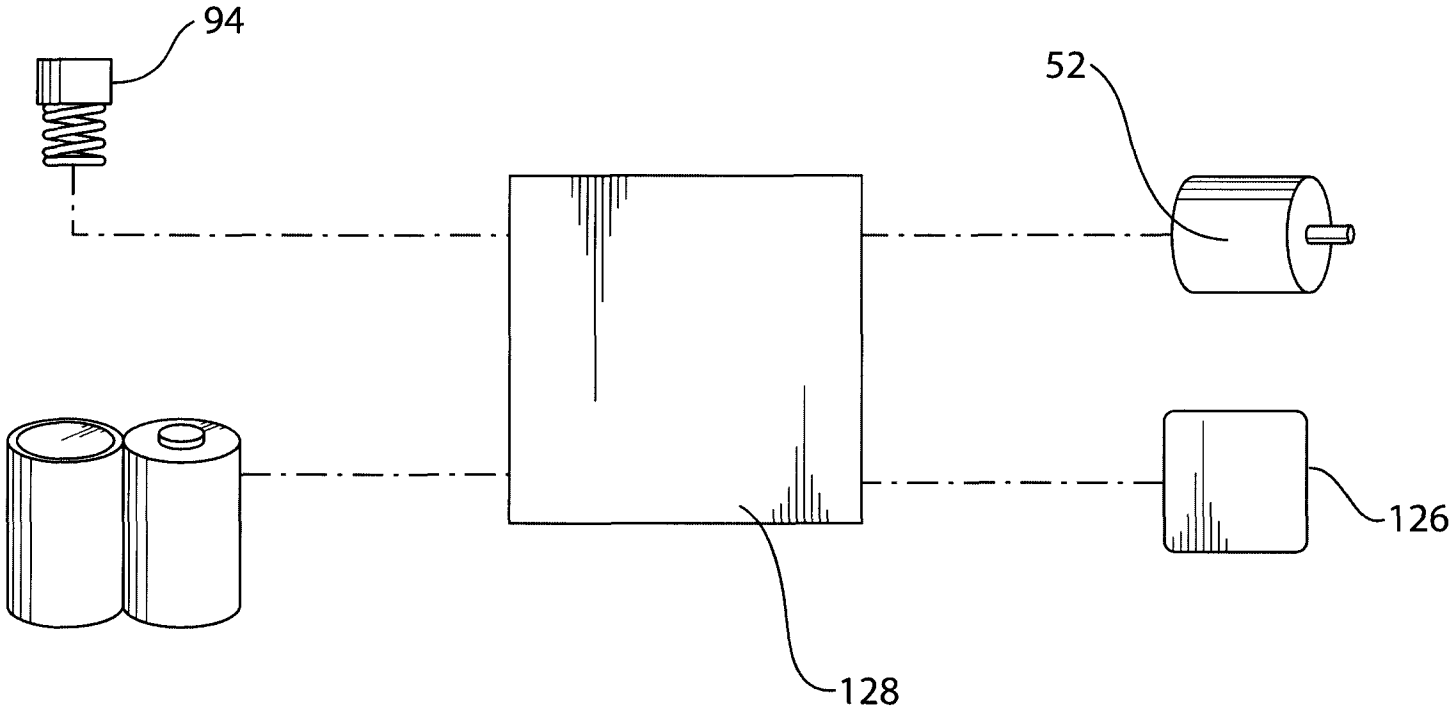
FIG. 15 is a diagram of selected electrical components from the sharpener shown in FIG. 14.

Reference is made to FIG. 14, which shows the sharpener 10 with an optional item imperfection sensor 126 which can detect imperfections in the skate blade 12 that require smoothing out. Such imperfections, as noted above may occur, for example, as a result of blade-to-blade engagement with skate blades 12 from other skaters. Such events can occur, for example, during a game of ice hockey. The item imperfection sensor 126 may have any suitable structure. For example, the item imperfection sensor 126 may be a capacitive sensor, whose capacitance changes upon exposure to an imperfection (eg. a nick) in the skate blade 12, relative to the capacitance sensed along smooth (ie. unnicked) portions of the skate blade 12. Upon encountering an imperfection, the item imperfection sensor 126 may send a corresponding signal to a controller 128 (FIG. 15). Upon receipt of such a signal from the item imperfection sensor 126, the controller 128 may optionally notify a user that an imperfection was encountered, thereby prompting the user to send power to operate the motor 52, eg. by depressing the button 94. The notification to the user may be achieved in any suitable way. For example, the controller 128 may illuminate an indicator light (eg. an LED), or may generate an audible sound, or both, when an imperfection is encountered. In some embodiments, the controller 128 could automatically send power to operate the motor 52 upon encountering an imperfection in the skate blade 12, instead of, or in addition to notifying the user of the presence of the imperfection by way of audible or visible indicating means. For some types of item imperfection sensor 126 it may be desirable to provide one proximate each corner edge 32 and 34 of the skate blade 12. It will be noted that in embodiments wherein the sensor 126 is provided only on one side of the sharpening base 40, the initiation of the motor 52 by the controller 94 will sharpen the imperfection only if the skate blade 12 and sharpener are being moved relative to each other in the directions shown by the direction arrows 127. If instead the skate blade 12 and the sharpener 10 are being moved in the opposite directions to the direction arrows 127, then the sharpening base 40 will not reciprocate along the imperfection. To address this, in some embodiments it may be desirable to provide one sensor 126 on either side of the sharpening base 40 (ie. both fore and aft longitudinally, of the sharpening base 40) so that the sharpening base 40 will be reciprocated over the imperfection regardless of which way the skate blade 12 and the sharpener 10 are being moved relative to each other.

In another embodiment the sharpener 10 may optionally have one or more item engagement sensors for sensing the presence of a skate blade 12 and also one or more item imperfection sensors 126. In such a case, the controller would operate the motor 52 if all of the one or more item engagement sensors indicate that a skate blade 12 is engaged properly in the slot 24 and if any item imperfection sensor 126 indicated that an imperfection was encountered. If any item engagement sensor did not signal the presence of a skate blade 12 the controller may stop the motor 52. If no item imperfection sensors 126 signal that an imperfection is encountered, the controller may stop the motor 52.

Figure 16:
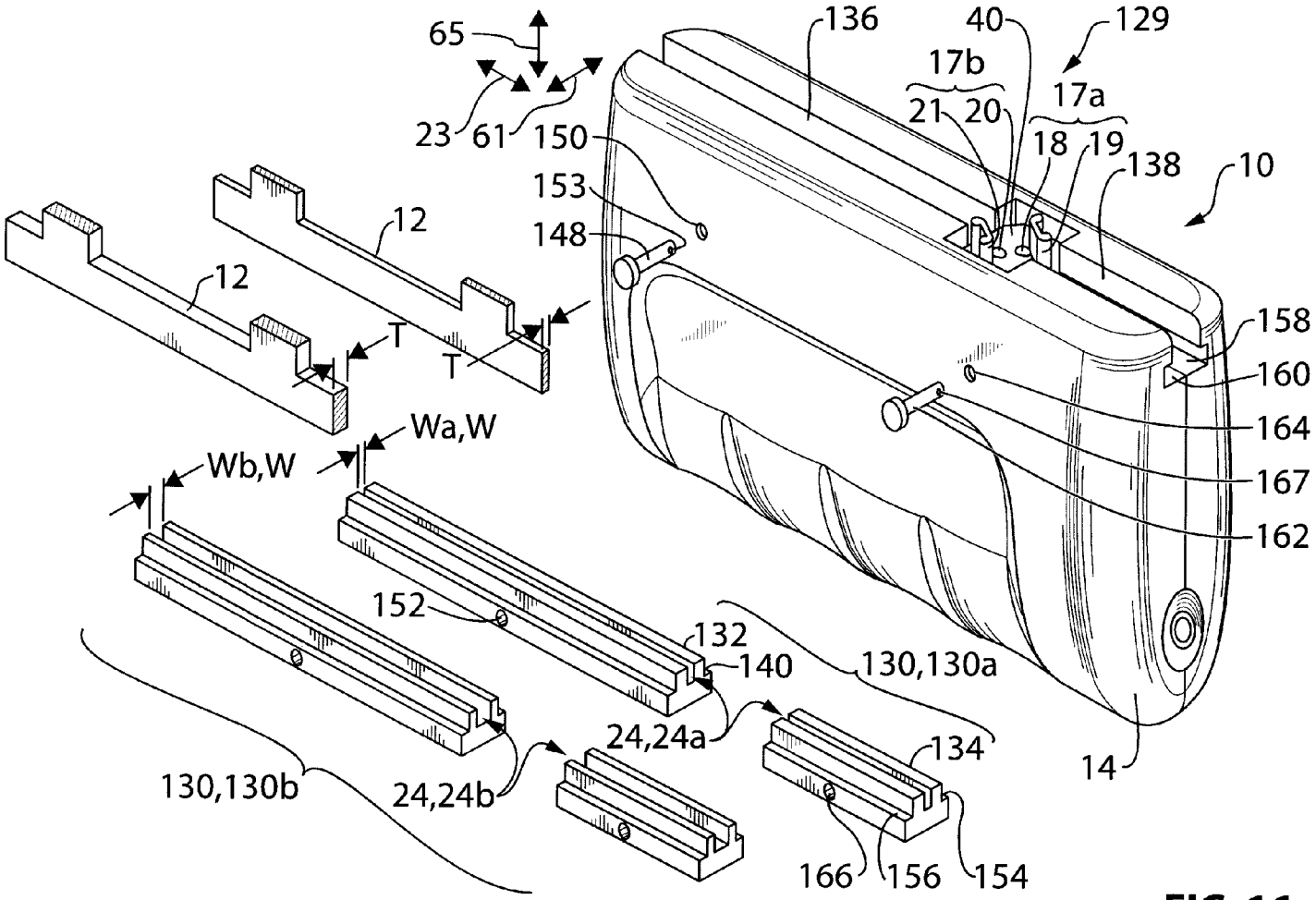
FIG. 16 is a perspective view of a kit of parts including the sharpener shown in FIG. 1*a* configured to receive a plurality of shoes for guiding different skate blades.

Reference is made to FIG. 16, which shows a kit of parts 129 including the sharpener 10 and a plurality of optional shoes, shown generally at 130 and individually at 130*a* and 130*b* (it will be understood that more than two shoes 130 could optionally be provided). Each shoe 130 contains a slot 24 having a unique width W for accommodating skate blades 12 having different thicknesses T. Thus, the shoe 130*a* has a slot 24*a* having a width Wa and the shoe 130*b* has a slot 24*b* having a width Wb. Each shoe 130 may be made up of a first shoe portion 132 and a second shoe portion 134. The first shoe portion 132 slides into a first shoe receiving slot 136 that is on a first side of the sharpening base 40. The second shoe portion 134 slides into a second shoe receiving slot 138 that is on a second side of the sharpening base 40. The first and second shoe portions 132 and 134 together define the slot 24 for receiving a skate blade 12.

Figure 16A:
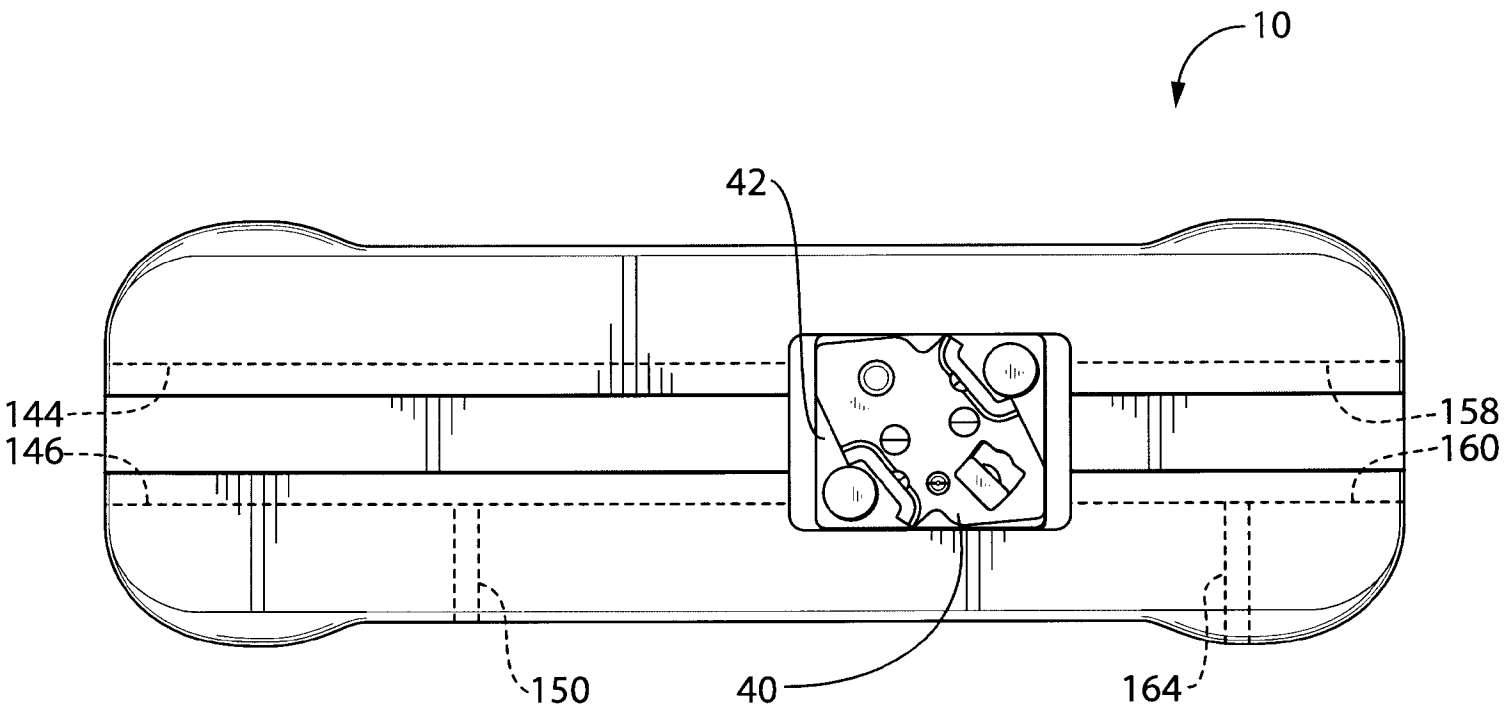
FIG. 16*a* is a plan view of the sharpener shown in FIG. 16.

One or more locking features may be provided to hold the first and second shoe portions 132 and 134 in place on the body 14 of the sharpener 10. For example, the first shoe portion 132 may have flanges 140 and 142, which are received in flange receiving slot regions 144 and 146 (FIG. 16*a*). The engagement of the first shoe portion 132 and the first shoe receiving slot 136 prevents movement of the first shoe portion transversely (ie. along the transverse direction line 61) and vertically (ie. along the third direction line 65). A first locking pin 148 may be provided, which passes through a first locking pin pass-through aperture 150 in the body 14 of the sharpener 10 and which passes into a first locking pin receiving aperture 152 in the first shoe portion 132, thereby preventing movement of the first shoe portion 132 longitudinally (ie. along the longitudinal direction line 23). The first locking pin 148 may have a mechanism for inhibiting the pin 148 from working its way out of the apertures 150 and 152 during use. For example, the first locking pin 148 may have a peripheral ball detent 153 thereon that engages a groove (not shown) in the first locking pin receiving aperture 152.

Similarly to the first shoe portion 132, the second shoe portion 134 may have flanges 154 and 156, which are received in flange receiving slot regions 158 and 160 to prevent movement of the second shoe portion 134 transversely (ie. along the transverse direction line 61) and vertically (ie. along the third direction line 65). A second locking pin 162 may be provided, which passes through a second locking pin pass-through aperture 164 in the body 14 of the sharpener 10 and which passes into a second locking pin receiving aperture 166 in the second shoe portion 134, thereby preventing movement of the second shoe portion 134 longitudinally (ie. along the longitudinal direction line 23). The second locking pin 162 may have a mechanism for inhibiting the pin 162 from working its way out of the apertures 164 and 166 during use. For example, the second locking pin 162 may have a peripheral ball detent 167 thereon that engages a groove (not shown) in the second locking pin receiving aperture 166.

Once in position in the first and second shoe receiving slots 136 and 138, the first and second shoe portions 132 and 134 are positioned to hold the skate blade 12 while providing clearance for the reciprocation of the sharpening base 40.

Figure 17A:
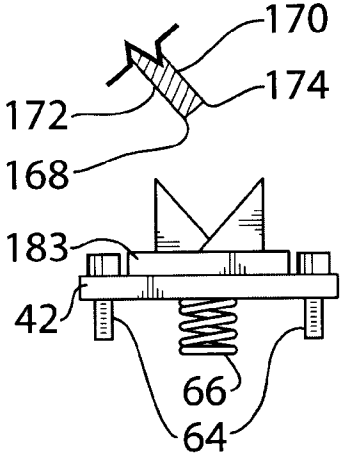
FIG. 17*a* is a side view of a sharpening base of the sharpener shown in FIG. 17.
Figure 17:
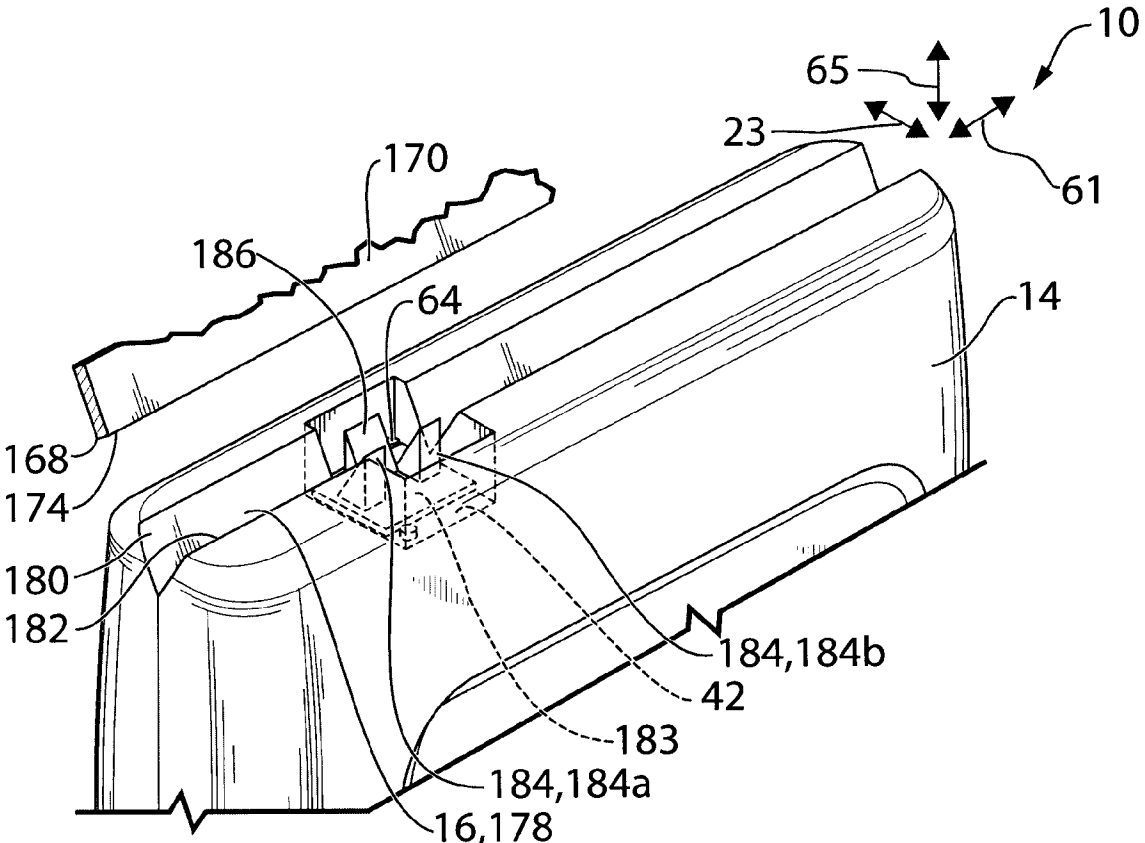
FIG. 17 is a perspective view of the sharpener shown in FIG. 1*a*, configured to sharpen a snow travel member such as a snowboard or a ski.

Reference is made to FIG. 17, which shows the sharpener 10 configured for sharpening a corner edge 168 of a snow travel member 170, such as a ski or a snowboard. Referring to FIG. 17*a*, the corner edge 168 represents the junction of a side face 172 and a bottom face 174 of the snow travel member 170. The sharpener 10 shown in FIG. 17 is configured to sharpen one corner edge 168 at a time. As a result, the size of the sharpener 10 shown in FIG. 17 may be kept small, thereby keeping it portable.

Instead of the slot 24 shown in FIG. 1*b*, the orienting structure 16 for the sharpener 10 shown in FIG. 17 may be, for example, a channel 178 in the body 14, for orienting the snow travel member 170 with respect to the sharpener 10. The channel 178 may have any suitable shape, such as a V-shape having an internal angle of about 90 degrees. The channel 178 has a bottom face receiving wall 180 and a side face receiving wall 182, for receiving the bottom face 174 (FIG. 17*a*) and side face 172 of the snow travel member 170.

The sharpener 10 shown in FIG. 17 includes a sharpening base 183 instead of the sharpening base 40 (FIG. 2). The sharpening base 183 may, as shown in FIG. 17, has mounted thereon a sharpening structure comprising two bottom face sharpening surfaces 184 (shown individually at 184*a* and 184*b*) and a side face sharpening surface 186, which are configured to form a V-shape when viewed along the longitudinal direction line 23, and which are configured to sharpen the bottom face 174 (FIG. 17*a*) and side face 172 respectively of the snow travel member 170. The angles of the bottom face sharpening surfaces 184 and the side face sharpening surface 186 match those of the bottom face receiving wall 180 and side face receiving wall 182 respectively. The side face sharpening surface 186 may be positioned longitudinally between the two bottom face sharpening surfaces 184. The sharpening base 182 may mount to the base support 42 in the same way as the sharpening base 40 shown in FIG. 2.

Instead of having two bottom face sharpening surfaces 184 and one side face sharpening surface 186, it is alternatively possible to have some other combination of surfaces, such as, for example, two side face sharpening surfaces 186 and a single bottom face sharpening surface 184. As another example, one side face sharpening surface 186 and one bottom face sharpening surface 184 may be provided.

The other elements of the sharpener 10 may be similar as appropriate to the corresponding elements of the sharpener 10 shown in the other figures.

During use, the sharpener 10 is moved along the length of the snow travel member 170 to permit the reciprocation of the sharpening base 40 to sharpen the corner edge 168. It will be noted that the sharpening base 182 need not rotate to a different orientation about the third direction line 65 in order to accommodate skis 170 having different thicknesses and widths. As a result, structure, such as the biasing members 82 and 84, shown in FIG. 5, that permitted the rotation of the sharpening base 40 about the third direction line 65, need not be included in the sharpener 10 shown in FIG. 17.

It is optionally possible for the item engagement sensor 108 (FIG. 10) and/or the item engagement sensors 116 (FIG. 13) and/or the one or more item imperfection sensors 126 (FIG. 14) described above to be incorporated into the sharpener 10 shown in FIG. 17 for use with the snow travel member 170.

Figure 18:
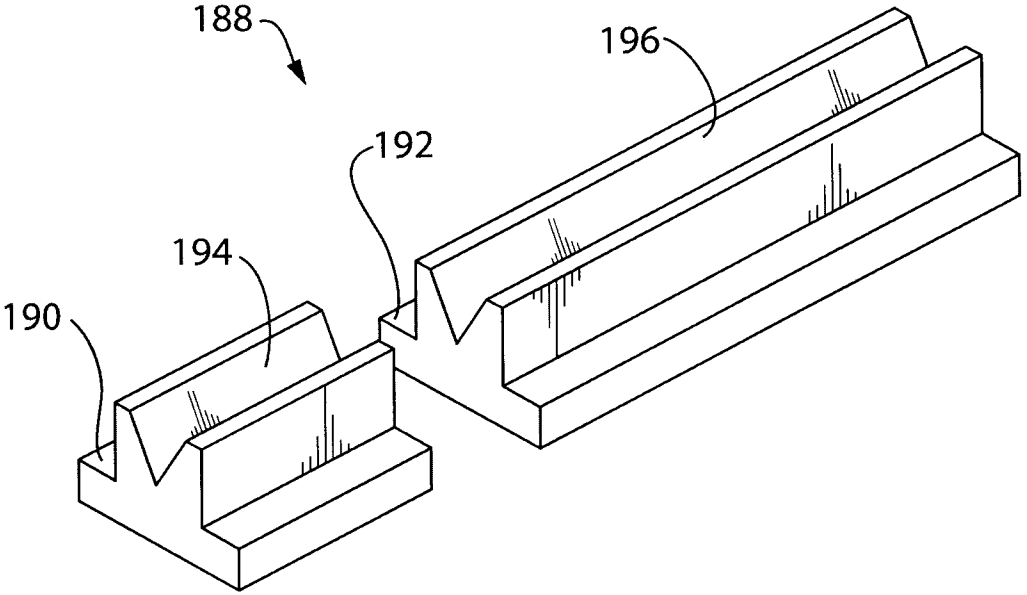
FIG. 18 is a shoe for use with the sharpener shown in FIG. 16, for sharpening a snow travel member such as a snowboard or a ski.

Referring to FIG. 18, a shoe 188 may be provided which, in conjunction with the sharpening base 182, would permit the sharpener 10 shown in FIG. 17 to sharpen a snow travel member 170, thus providing the sharpener 10 with the capability to sharpen ice skates, skis and snowboards. The shoe 188 (FIG. 18) includes a first shoe portion 190 and a second shoe portion 192, which can be inserted into the first and second shoe receiving slots 136 and 138 respectively of the sharpener 10 shown in FIG. 16. The first and second shoe portions 190 and 192 may have generally V-shaped channels, shown at 194 and 196 respectively, for holding the bottom face 174 and side face 172 (FIG. 17*a*) of the snow travel member 170.

The sharpener 10 has been described in at least some embodiments as being configured to provide sharpening capability to a plurality of thicknesses of skate blade, and to other snow/ice travel members such as snowboards and skis, and may further be portable (with battery and/or A/C power). It is possible that at least some of the features of the sharpener 10 could be applied to a stationary (ie. non-portable) sharpener.

Figure 19:
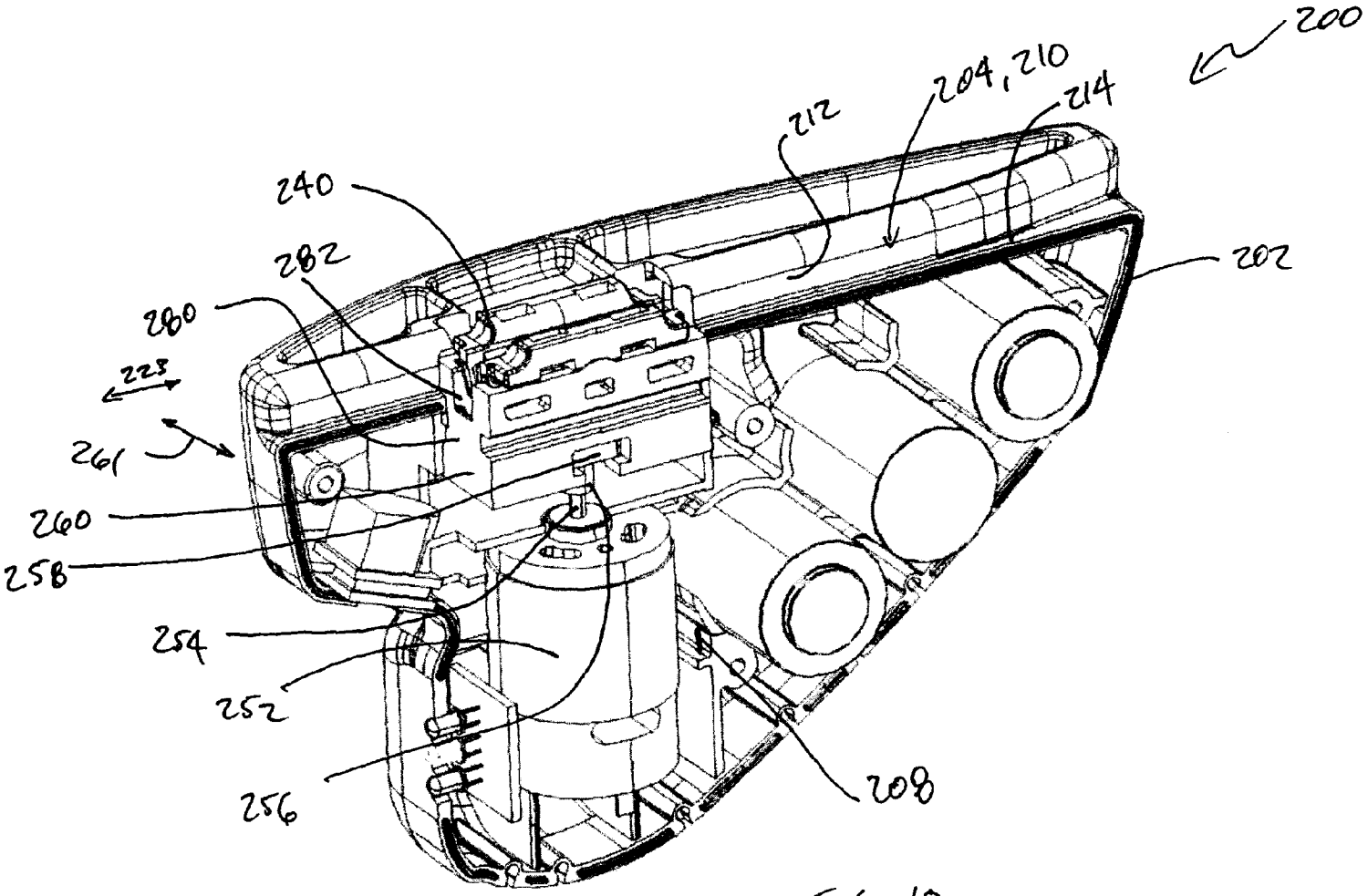
FIG. 19 is a perspective view of a sharpener (with a portion removed) in accordance with another embodiment of the present invention.

Reference is made to FIG. 19, which shows a sharpener 200 in accordance with another embodiment of the present invention. The sharpener 200 may be similar to the sharpener 10 (FIG. 1), and may include a body 202 (a portion of which is removed to show the components inside it), a skate blade orienting structure 204, a first corner edge sharpening structure 206*a* (FIG. 20) for sharpening the first corner edge 32, a second corner edge sharpening structure 206*b* for sharpening the second corner edge 34 (FIG. 20), and a drive mechanism 208 (FIG. 19) for driving the movement of the first and second corner edge sharpening structures 206*a* and 206*b* (FIG. 20) relative to the body 202 (FIG. 19).

The body 202 may be a two-piece assembly (one of the pieces is not shown, as noted above), and may be made from a suitable material such as a molded plastic.

Figure 20:
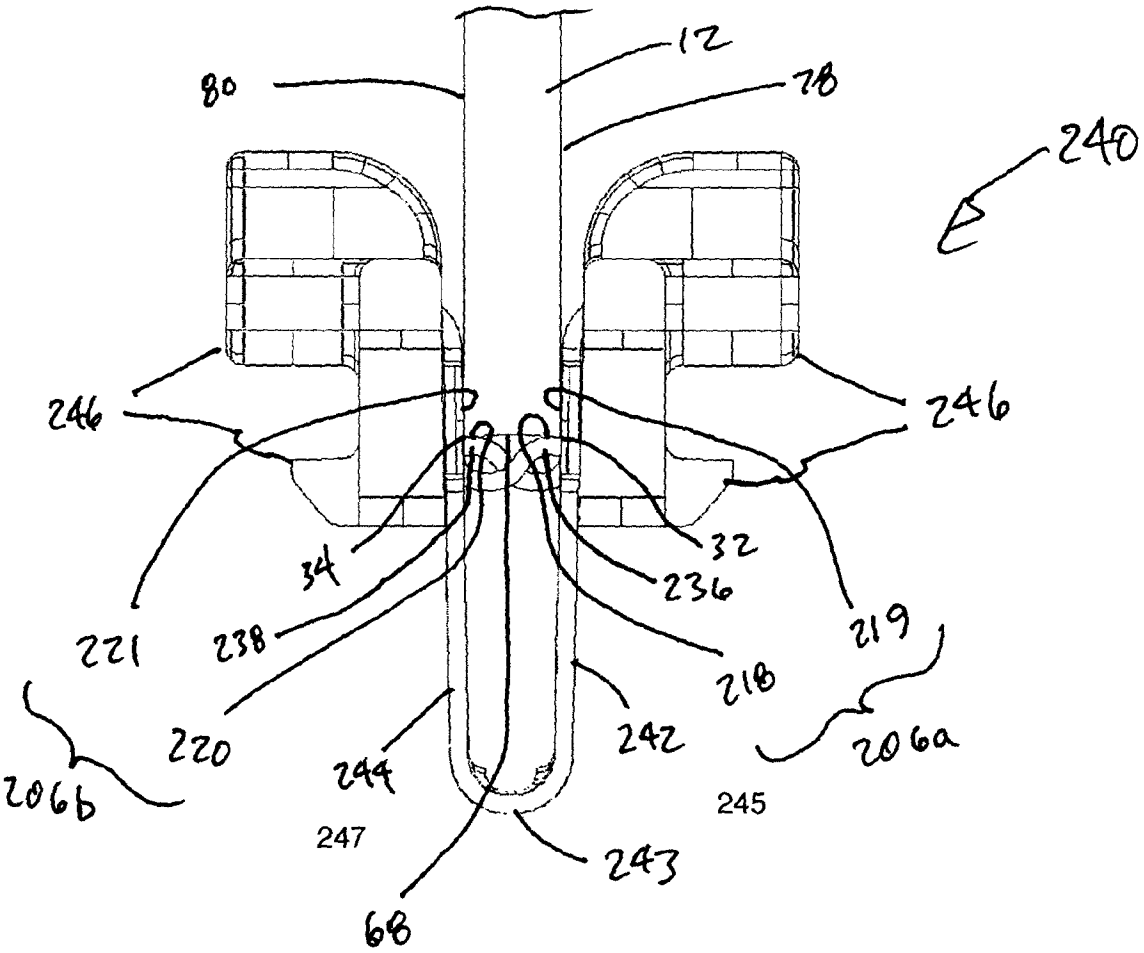
FIG. 20 is an end view of a component (a sharpening head) from the sharpener shown in FIG. 19.

The skate blade orienting structure 204 may be a slot 210 in the body 202, similar to the slot 24 in the body 14 in FIG. 1. The slot 210 has a first slot side wall 212, a second slot side wall (not shown) and a slot floor 214. The first and second slot side walls are engageable with the first and second side faces 78 and 80 of the skate blade 12 (FIG. 20). The slot floor 214 (FIG. 19) sets the position (the height specifically) of the edge face 68 (FIG. 20) and may be referred to as an edge face positioning surface 214. Due to the concavity of the edge face 68, the slot floor 214 may engage the first and second corner edges 32 and 34 and be spaced from the edge face 68 itself.

Figure 21:
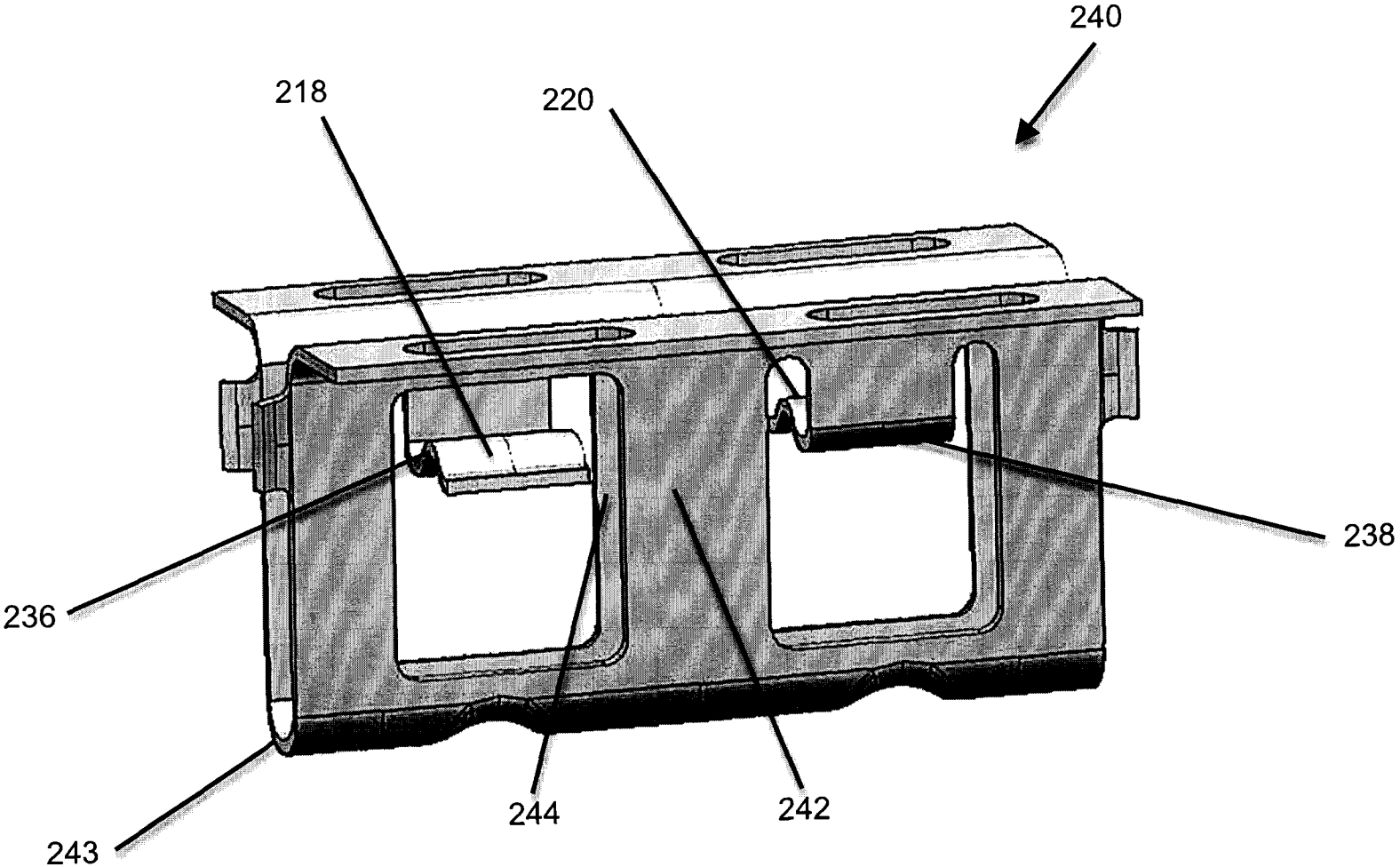
FIG. 21 is a perspective view of the sharpening head shown in FIG. 20.

Referring to FIGS. 20 and 21, the first and second corner edge sharpening structures 206*a* and 206*b* are positioned on a sharpening base 240. The first corner edge sharpening structure 206*a* includes a first edge face sharpening surface 218 and a first side face sharpening surface 219. Similarly, the second corner edge sharpening structure 206*b* includes a second edge face sharpening surface 220 and a second side face sharpening surface 221.

As shown in FIG. 20, the first edge face sharpening surface 218 is positioned for sharpening the edge face 68 proximate the first corner edge 32, and the first side face sharpening surface 219 is positioned for sharpening the first side face 78 proximate the first corner edge 32. Similarly, the second edge face sharpening surface 220 is positioned for sharpening the edge face 68 proximate the second corner edge 34, and the second side face sharpening surface 221 is positioned for sharpening the second side face 80 proximate the second corner edge 34. The first and second edge face sharpening surfaces 218 and 220 are angled downwardly in a laterally outward direction (ie. in a lateral direction away from each other). In this way, they maintain the concavity of the edge face 68 of the skate blade 12.

When the sharpening base 240 is viewed along a longitudinal direction of the sharpener 200 the first edge face sharpening surface 218 and the first side face sharpening surface 219 appear to intersect. Similarly, the second edge face sharpening surface 220 and the second side face sharpening surface 221 appear to intersect. This is because the first and second edge face sharpening surfaces 218 and 220 have laterally outer edges that are laterally outboard of the first and second side face sharpening surfaces 219 and 221 respectively. As a result, as the sharpening base 240 is passed along the length of the skate blade 12, the sharpening surfaces 218, 219, 220 and 221 cooperate to provide relatively sharp first and second corner edges 32 and 34.

The first and second side face sharpening surfaces 219 and 221 may be sloped laterally towards each other slightly and the lower portions of these sharpening surfaces 219 and 221 extend into the slot 212 (FIG. 19), so that they are ensured of engagement with the first and second side faces 78 and 80 of the skate blade 12.

The sharpening surfaces 218, 219, 220 and 221 may be made in any suitable way. For example, they may be covered with an abrasive material such as diamond, or Cubic Boron Nitride (CBN).

As shown more clearly in FIG. 21, the first and second edge face sharpening surfaces 218 and 220 may be surfaces on separate first and second tongues 236 and 238 respectively on the sharpening base 240. The first and second tongues 236 and 238 are resiliently connected to first and second side walls 242 and 244 of the sharpening base 240, such that the first tongue 236 is connected to the second side wall 244 and the second tongue 238 is connected to the first side wall 242. The resilient connections permit the tongues 236 and 238 to flex as necessary to accommodate a skate blade 12 being placed in the slot 212 into engagement with the slot floor 214. In the embodiment shown in FIG. 21, the resilient connection is provided by cutting and bending the tongues 236 and 238 from the side walls 242 and 244, thereby saving the cost, assembly time, and complexity associated with having separate spring members to provide resiliency. It is nonetheless contemplated that a separate spring member could alternatively be provided for biasing the first and second edge face sharpening surfaces 218 and 220 toward a selected position.

Figure 27:
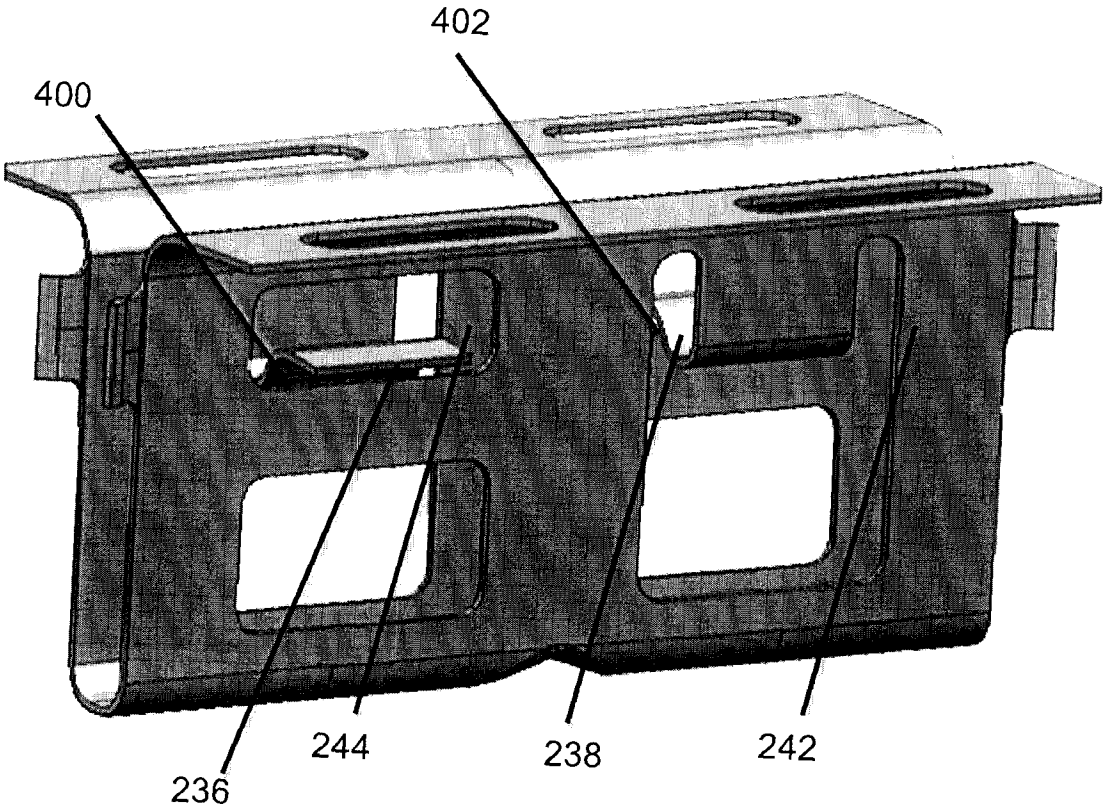
FIG. 27 is a perspective view of a variant of the sharpening head shown in FIG. 20.

An optional feature that prevents the tongues from being deflected by the skate blade 12 (FIG. 3) to the point of yielding is shown in FIG. 27. In the embodiment shown in FIG. 27, tongue flexure limit structures 400 and 402 are provided in the first side wall 242 under the first tongue 236 and in the second side wall 244 under the second tongue 238. The limit structures 400 and 402 are positioned to permit a selected amount of deflection of the tongues 236 and 238 but prevent deflection that would damage the tongues. In this way, if a user inserts a corner of the blade 12 into the sharpening base 240 (thereby avoiding contact with the slot floor 214 (FIG. 19)), and uses too much force, the tongues 236 and 238 are protected from being overflexed.

The first and second side walls 242 and 244 are themselves resiliently joined together by a resilient hinge portion 243 at the their respective bottom ends, shown at 245 and 247. The resilient hinge portion 243 permits the first and second side walls 242 and 244 to resiliently spread apart as necessary to accommodate a range of thicknesses of skate blade 12, but biases the first and second walls 242 and 244 back towards a rest position for accommodated narrower skate blades 12. Having the integral hinge portion 243 further saves cost, assembly time and complexity that would associated with having a separate spring member resiliently connecting the first and second side walls 242 and 244. It is nonetheless contemplated that some other means for resiliently biasing the first and second side walls 242 and 244 towards the skate blade 12 could alternatively be provided.

Figure 22:
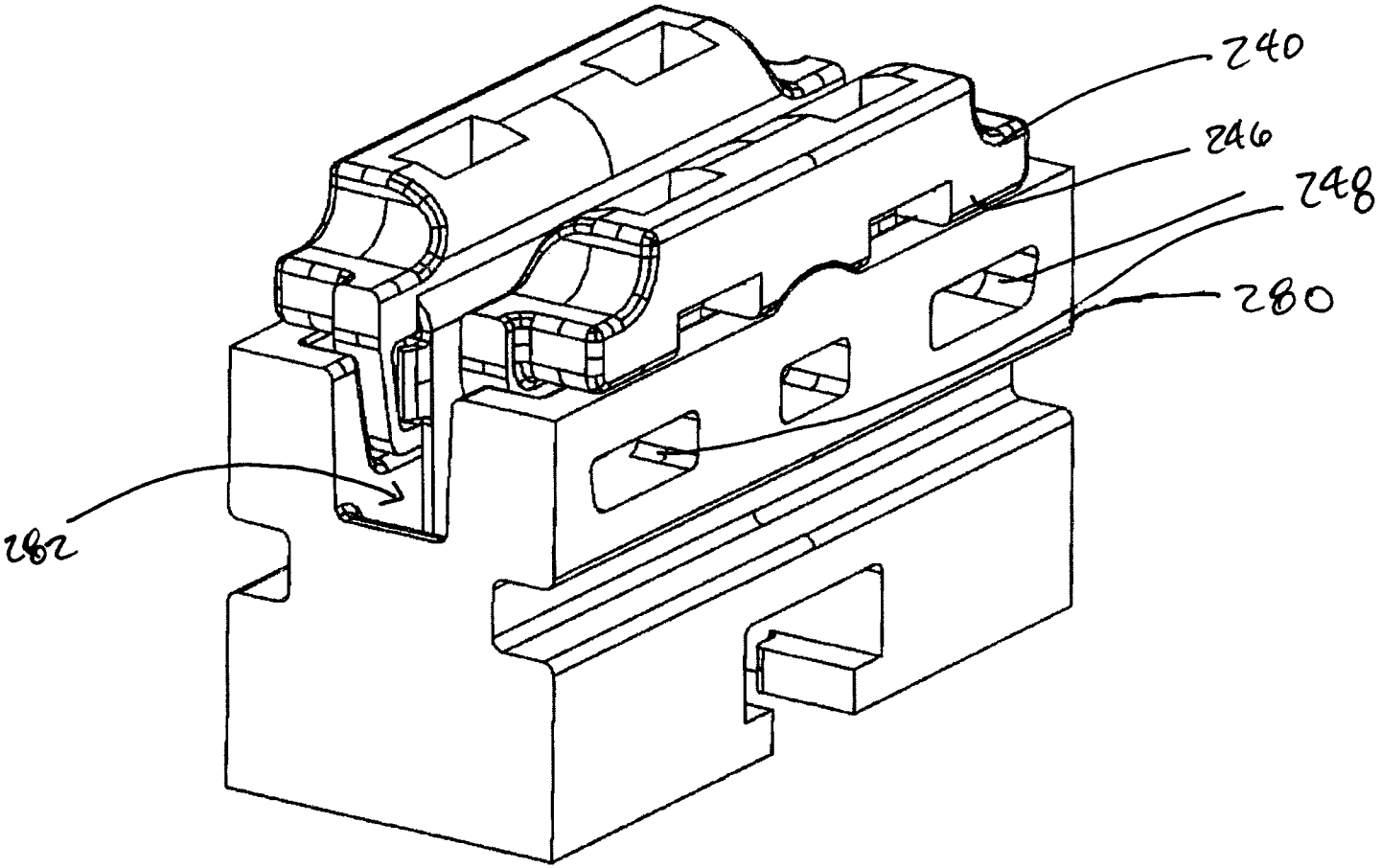
FIG. 22 is a perspective view of the sharpening head shown in FIG. 20, shown mounted in a base support.
Figure 22A:
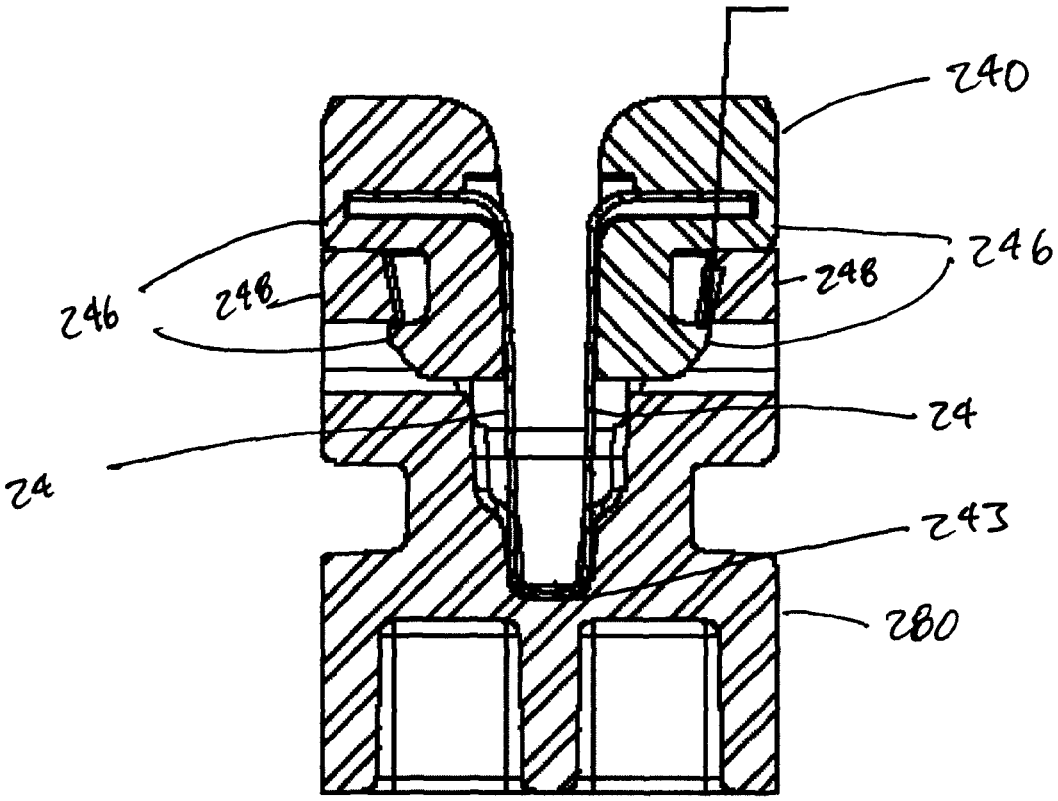
FIG. 22*a* is a sectional elevation view of the mounted sharpening head shown in FIG. 22.

Reference is made to FIG. 22*a*, which shows a sectional view of the sharpening base 240 mounted in the base support 280. As shown in the figure, the clip portions 246 are connected with the clip receiving features 248, however there is room for the side walls 242 and 244 of the sharpening base 240 to spread apart when receiving a skate blade 12 (FIG. 20) therebetween. Also, it can be seen that the lower portion of the sharpening base 240 mounts into a mating form in the base support 280 which ensures that the sharpening base 240 sits in an upright position when installed in the base support 280.

It is alternatively possible for the first and second edge face sharpening surfaces 218 and 220 to be portions of a surface of a single tongue or similar feature.

The first and second side face sharpening surfaces 219 and 221 may be on the first and second side walls 242 and 244 respectively, which are also on the sharpening base 240.

Referring to FIG. 19 the sharpening base 240 may be made removable from the rest of the sharpener 200 so that it can be replaced with a new sharpening base 240 when it wears out and is no longer effective. Thus, the sharpening base 240 may be considered to be a disposable part of the sharpener 200, and the rest of the sharpener 200 may be considered to be non-disposable, at least in some embodiments.

Referring to FIG. 22, the sharpening base 240 may removably lock into a base support 280, by any suitable connecting structure. For example, the sharpening base 240 may include one or more clip portions 246 (shown in FIG. 20), which mate with clip receiving features 248 (FIG. 22) on the base support 280. To mount the sharpening base 240 onto the base support 280, the sharpening base 240 is simply pushed down into the receiving slot 282 of the base support 280. The side walls 242 and 244 of the sharpening base 240 are squeezed inwardly towards each other as the sharpening base 240 is pushed into place in the receiving slot 282. Once the base 240 is in place, the clip portions 246 snap into place around the clip receiving features 248. In the view shown in FIG. 21, the molded plastic portion of the sharpening base 240 has been removed so as not to obscure other portions of it.

To remove a worn sharpening base 240 from the base support 280, the user simply squeezes the clip portions 246 together (flexing the resilient hinge member 243), which disengages the clip portions from the clip receiving features 248, at which point the sharpening base 240 may be pulled directly out of the receiving slot 282.

The sharpening base 240 may be made from a suitable metal, such as a type of steel that can be stamped or from a powdered metal. Additionally, the clip portions 246 may be molded onto a metallic portion of the base 240 at a suitable position for engaging the clip receiving features 248.

Referring to FIG. 19, the base support 280 is driven by the drive mechanism 208. The drive mechanism 208 includes a motor 252 with an output shaft 254 which has an offset drive member 256 thereon that is offset from the output shaft axis. The drive mechanism 208 further includes a first driven member 258 and a second driven member 260. The first driven member 258 is slidably mounted to the second driven member 260. The second driven member 260 is configured to restrict the first driven member 258 to only have freedom of movement approximately along a transverse direction line shown at 261. The second driven member 260 is slidably mounted on rails (not shown) and is restricted by the rails to only have freedom of movement along the longitudinal direction line shown at 223. The rails are integral with the body 202. The second driven member 260 is integral with the base support 280.

Operation of the drive mechanism 208 generates reciprocation of the base support 42, and therefore the sharpening surfaces 218, 219, 220 and 221 along a reciprocation path along the longitudinal direction line 223, similar to the operation of the drive mechanism 22 in the embodiment shown in FIG. 2.

In the event that a skate blade 12 that is thinner than the slot 212 is inserted in the slot 212 for sharpening, it is possible that the skate blade 12 could be rotated slightly so that it was not strictly aligned with the longitudinal direction line 223. It will be noted that the structure of the sharpening base 240 permits some angular misalignment in the blade 12 relative to the sharpener 200 while keeping the sharpening surfaces 218, 219, 220 and 221 at least generally correctly oriented relative to the skate blade 12 itself.

Figure 23:
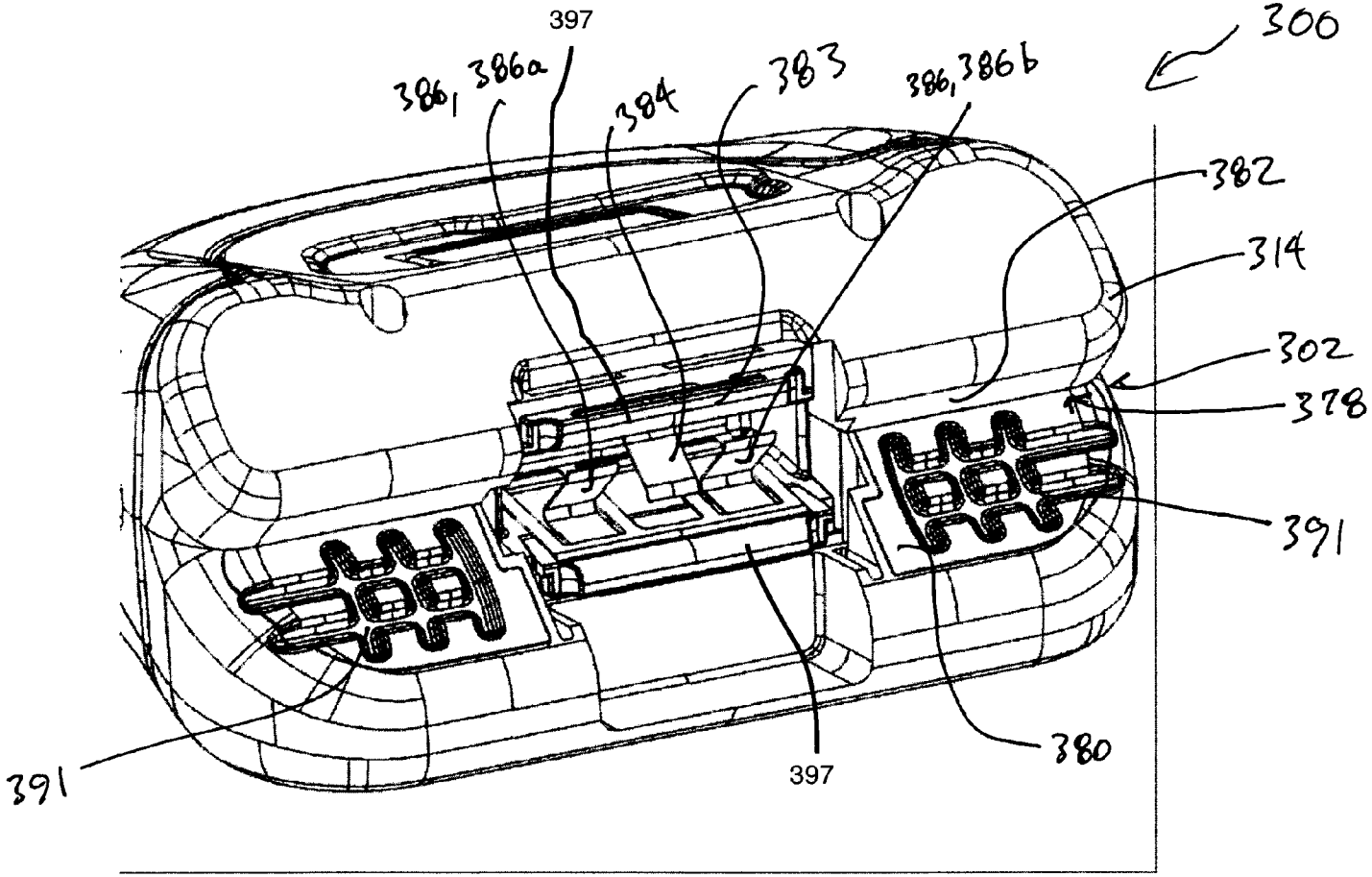
FIG. 23 is a perspective view of a sharpener (with a portion removed) in accordance with another embodiment of the present invention, for sharpening a snow travel member such as a snowboard or a ski.
Figure 24:
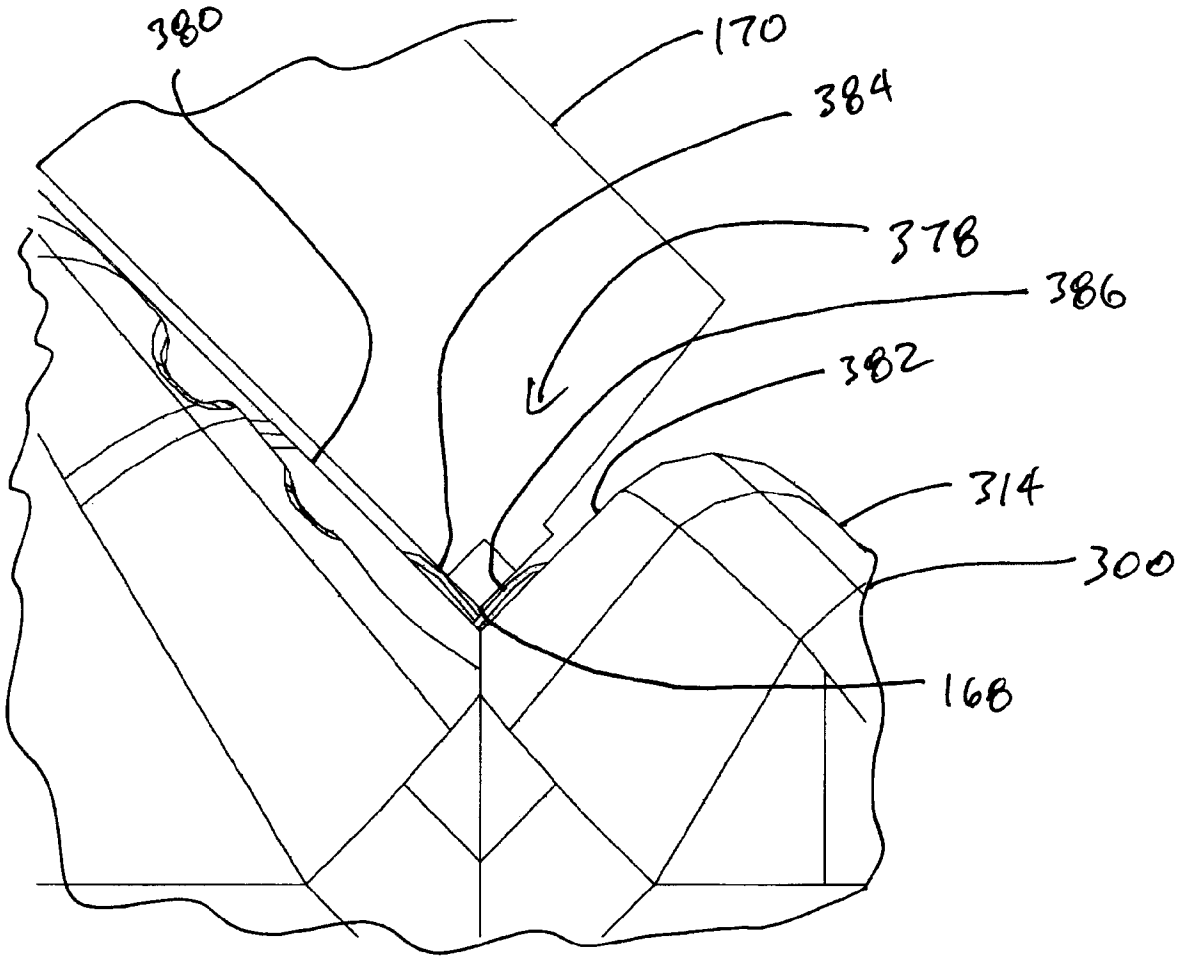
FIG. 24 is a magnified elevation view of a portion of the sharpener shown in FIG. 23.

Reference is made to FIG. 23, which shows a sharpener 300 in accordance with another embodiment of the present invention. The sharpener 300 may be similar to the sharpener 200 (FIG. 19), but is configured to sharpen one corner edge 168 (FIG. 24) of a snow travel member 170 such as a ski or snowboard or the like. The sharpener 300 is configured to sharpen one corner edge 168 at a time.

A snow/ice travel member orienting structure for the sharpener 300 is shown at 302 may be similar to the orienting structure 16 on the sharpener 10 shown in FIG. 17 and may be a channel 378 in the body 314. The channel 378 may have any suitable shape, such as a V-shape (best seen in FIG. 24) having an internal angle of 90 degrees. The channel 378 has a bottom face receiving wall 380 and a side face receiving wall 382, for receiving the bottom face 174 (FIG. 24) and the side face 172 respectively of the snow travel member 170. The bottom face receiving wall 380 optionally includes a plurality of debris removal grooves 391 (FIG. 23), which collect and remove debris such as snow, dirt and ice from the bottom face 174 (FIG. 24) of the snow travel member 170 to inhibit the debris from getting into and damaging the drive mechanism inside and from interfering with the sharpening process.

Figure 25:
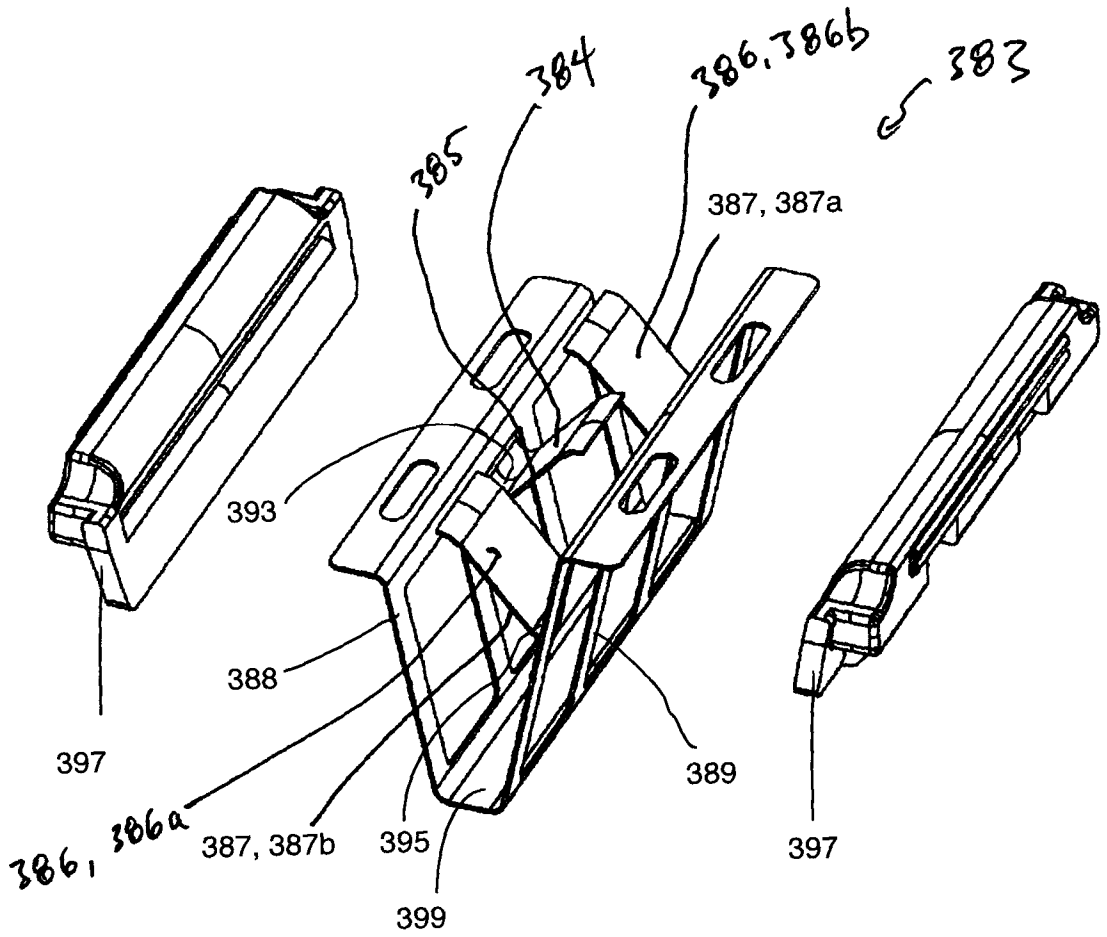
FIG. 25 is an exploded perspective view of a sharpening head from the sharpener shown in FIG. 23.
Figure 26:
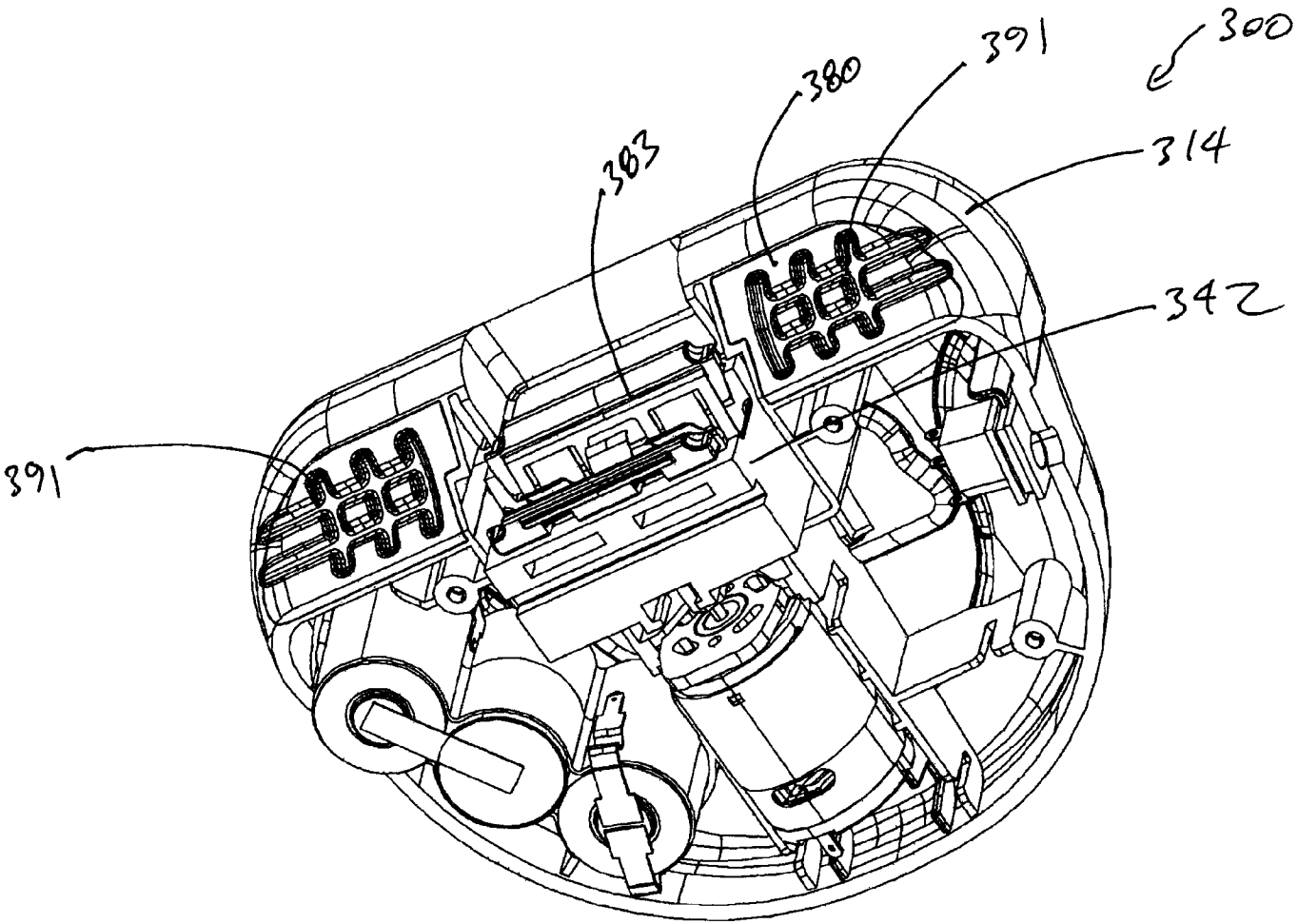
FIG. 26 is another perspective view of the sharpener shown in FIG. 23 with a portion removed.

The sharpener 300 includes a sharpening base 383 which is shown in exploded view in FIG. 25. The sharpening base 383 has mounted thereon a sharpening structure comprising a bottom face sharpening surface 384 and two side face sharpening surfaces 386 (shown individually at 386*a* and 386*b*), which together form a V-shape when viewed along the longitudinal direction line, and which are configured to sharpen the bottom face 174 (FIG. 24) and side face 172 respectively of the snow travel member 170. The base support is shown at 342 (FIG. 26) and may be similar to the base support 280 shown in FIG. 19. The sharpening base 383 may mount to the base support 342 in the same way as the sharpening base 240 shown in FIG. 19.

Referring to FIG. 25, the sharpening surfaces 384 and 386 may be provided on tongues 385 and 387 which are integrally and resiliently joined through resilient hinge members 393 and 395 to first and second walls 388 and 389 respectively which form part of the sharpening base 383. The resilient connection permits the tongues to extend upwards into the channel 378 (FIG. 24) and to resiliently urge the sharpening surfaces 384 and 386 into engagement with the snow travel member 170 when it is pressed down into engagement with the channel 378. In the embodiment shown, there are first, second and third tongues provided, namely first tongue 385, second tongue 387*a* and third tongue 387*b* and thus there are two sharpening surfaces for the side face 172 and one sharpening surface for the bottom face 174 of the snow/ice travel member 170. However, other combinations of tongues and sharpening surfaces may alternatively be provided. There may be the same number of tongues for sharpening the side face as there are for the bottom face. There may be more tongues for the bottom face than for the side face. The tongues (and therefore the sharpening surfaces) need not have the same longitudinal dimension. In the view shown in FIG. 24, the snow travel member 170 is just being introduced into the channel 378 and has not yet caused flexing of the tongues 385 and 387.

The first and second walls 388 and 389 may at their bottom ends be joined by a resilient hinge member 399, in similar manner to the first and second walls 242 and 244 and hinge member 243 of the sharpening base 240 shown in FIG. 21. The resilient hinge member 399 permits flexure of the first and second walls 388 and 389 towards each other for removal of the sharpening base 383 from the sharpener 300 and for urging the clip portions shown at 397, into clip receiving portions on the sharpener 300 (FIG. 23).

The other elements of the sharpener 10 may be similar as appropriate to the corresponding elements of the sharpener 10 shown in FIG. 17 and in the other figures.

During use, the sharpener 300 is moved along the length of the snow travel member 170 to permit the reciprocation of the sharpening base 383 to sharpen the corner edge 168.

While each of the embodiments described has included a drive mechanism including a motor and structure for generating reciprocating motion from the motor's rotation, it is alternatively possible to provide a sharpener for skates, or skis or the like, that is manually operated, (ie. the sharpening is carried out by manually sliding the sharpener along the blade of the skate or ski by the user for sharpening the skate or ski). For example, the manual sharpener could include a handle that has at its end a structure similar to the base support shown in any of the embodiments described and shown herein, for receiving a sharpening head in accordance with one of the embodiments described and shown herein.

While the above description constitutes a plurality of embodiments of the present invention, it will be appreciated that the present invention is susceptible to further modification and change without departing from the fair meaning of the accompanying claims.

The invention claimed is:

1. A sharpener, comprising:

a body;

a skate blade orienting structure, configured to orient a skate blade along a longitudinal direction line;

a first sharpening surface positioned for sharpening a first corner edge of the skate blade and a second sharpening surface positioned for sharpening a second corner edge of the skate blade; and a drive mechanism configured to move the first and second sharpening surfaces reciprocally relative to the body along a reciprocation path along the longitudinal direction line, wherein the body includes an edge face positioning surface for receiving an edge face of the skate blade, and wherein the sharpener further includes a sharpening surface engagement biasing member that is configured to urge the first and second sharpening surfaces to the edge face.

2. A sharpener as claimed in claim 1, wherein the drive mechanism includes a motor.

3. A sharpener as claimed in claim 2, wherein the motor includes an output shaft rotatable about an output shaft axis, wherein the output shaft includes an offset drive member that is offset from the output shaft axis, and wherein the drive mechanism includes a first driven member and a second driven member, wherein the offset drive member is operatively connected to the first driven member, wherein the first driven member is operatively connected to the second driven member and is slidable at least approximately laterally relative to the second driven member, and wherein the second driven member is slidable at least approximately longitudinally relative to the body, and is operatively connected to the first and second sharpening surfaces.

4. A sharpener as claimed in claim 1, further comprising a first skate blade side face guide surface and a second skate blade side face guide surface, wherein the first and second skate blade side face guide surfaces are spaced apart from each other laterally by a lateral spacing and configured to receive therebetween the skate blade and for centering the skate blade on the first and second sharpening surfaces.

5. A sharpener as claimed in claim 4, wherein the first and second skate blade side face guide surfaces include an abrasive thereon for sharpening a first side face and a second side face of the skate blade.

6. A sharpener, comprising:

a body including an edge face positioning surface for receiving an edge face of a skate blade;

at least one sharpening surface positioned for sharpening a corner edge of the skate blade;

a drive mechanism configured to move the at least one sharpening surface relative to the body; and a sharpening surface biasing member that, in use, is configured to urge the at least one sharpening surface to the edge face of the skate blade, wherein the at least one sharpening surface includes a first sharpening surface configured for sharpening a first corner edge of the skate blade and a second sharpening surface configured for sharpening a second corner edge of the skate blade.

7. A sharpener as claimed in claim 6, further comprising a sharpening base, wherein the first sharpening surface and the second sharpening surface are mounted on the sharpening base and wherein, in use, the sharpening base is movable by the sharpening surface engagement biasing member to the edge face of the skate blade.

8. A sharpener, comprising:

a body including an edge face positioning surface for receiving an edge face of a skate blade;

at least one sharpening surface positioned for sharpening a corner edge of the skate blade;

a drive mechanism configured to move the at least one sharpening surface relative to the body;

a sharpening surface biasing member that, in use, is configured to urge the at least one sharpening surface to the edge face of the skate blade; and at least one item engagement sensor positioned to sense the engagement of the skate blade with the sharpening surface, wherein the item engagement sensor is positioned to detect movement of the sharpening surface against the force of the sharpening surface engagement biasing member.

9. A sharpener as claimed in claim 8, further comprising at least one item imperfection sensor positioned to sense any imperfections on the corner edge of the skate blade.

10. A sharpener, comprising:

a body including an edge face positioning surface for receiving an edge face of a skate blade;

at least one sharpening surface positioned for sharpening a corner edge of the skate blade;

a drive mechanism configured to move the at least one sharpening surface relative to the body; and a sharpening surface biasing member that, in use, is configured to urge the at least one sharpening surface to the edge face of the skate blade; and wherein the at least one sharpening surface is provided on a disposable element that is removably connectable to a non-disposable portion of the sharpener, wherein the disposable element is a sharpening base, and wherein the at least one sharpening surface and the sharpening surface biasing member are integral with each other, wherein the sharpening base includes a first wall and a second wall, wherein the at least one sharpening surface and the at least one sharpening surface biasing member are positioned on at least one tongue that extends from at least one of the first and second walls towards the other of the first and second walls.

11. A sharpener as claimed in claim 10, wherein the first and second walls each have a bottom end and wherein the sharpening base further comprises a resilient hinge member that connects the first and second walls together at the bottoms ends and biases the first and second walls towards a rest position.

12. A sharpener, comprising:

a body including an edge face positioning surface for receiving an edge face of a skate blade;

at least one sharpening surface positioned for sharpening a corner edge of the skate blade;

a drive mechanism configured to move the at least one sharpening surface relative to the body; and a sharpening surface biasing member that, in use, is configured to urge the at least one sharpening surface to the edge face of the skate blade, wherein the at least one sharpening surface is provided on a disposable element that is removably connectable to a non-disposable portion of the sharpener, wherein the disposable element is a sharpening base, and wherein the at least one sharpening surface and the sharpening surface biasing member are integral with each other, wherein the sharpening base includes a first wall and a second wall, wherein the at least one sharpening surface includes a first edge face sharpening surface and a first side face sharpening surface, wherein the first edge face sharpening surface and the first side face sharpening surface are positioned on a first tongue that extends from one of the first and second walls towards the other of the first and second walls, and wherein the first edge face sharpening surface and the first side face sharpening surface cooperate to sharpen a first corner edge of the skate blade, and wherein the at least one sharpening surface further includes a second edge face sharpening surface and a second side face sharpening surface, wherein the second edge face sharpening surface and the second side face sharpening surface are positioned on a second tongue that extends from the other of the first and second walls towards the one of the first and second walls, and wherein the second edge face sharpening surface and the second side face sharpening surface cooperate to sharpen a second corner edge of the skate blade.

13. A sharpener as claimed in claim 12, further comprising first and second tongue flexure limit structures positioned to limit the travel of the first and second tongues respective.

* * * * *